US009740142B2

(12) United States Patent
Izumi et al.

(10) Patent No.: US 9,740,142 B2
(45) Date of Patent: Aug. 22, 2017

(54) TONER CASE AND IMAGE FORMING APPARATUS INCLUDING THE SAME

(71) Applicant: KYOCERA Document Solutions Inc., Osaka (JP)

(72) Inventors: Koji Izumi, Osaka (JP); Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/371,873

(22) Filed: Dec. 7, 2016

(65) Prior Publication Data

US 2017/0168426 A1 Jun. 15, 2017

(30) Foreign Application Priority Data

Dec. 9, 2015 (JP) ..... 2015-240484

(51) Int. Cl.
*G03G 15/09* (2006.01)
*G03G 15/08* (2006.01)
*G03G 15/095* (2006.01)

(52) U.S. Cl.
CPC ..... *G03G 15/095* (2013.01); *G03G 15/0834* (2013.01); *G03G 15/0865* (2013.01); *G03G 15/0868* (2013.01)

(58) Field of Classification Search
CPC ..... G03G 15/0868; G03G 15/0834; G03G 15/0836; G03G 15/087; G03G 2215/0678
See application file for complete search history.

(56) References Cited

U.S. PATENT DOCUMENTS 5,006,894 A * 4/1991 Morris ..... G03G 15/0855 141/364
7,450,890 B2 * 11/2008 Murakami ..... G03G 15/0868 399/258
9,383,686 B2 * 7/2016 Murakami ..... G03G 15/0865

FOREIGN PATENT DOCUMENTS

JP 2010-217592 A 9/2010

* cited by examiner

*Primary Examiner* — Gregory H Curran
(74) *Attorney, Agent, or Firm* — Studebaker & Brackett PC

(57) ABSTRACT

A toner case includes a case main body and a cleaning member. The case main body is capable of containing a toner supplied to an image forming part arranged inside an apparatus main body and is attachable to and detachable from a supplying attachment part of the apparatus main body along an attachment and detachment direction. The cleaning member is arranged at an outer circumferential face of the case main body. The case main body rotates inside the supplying attachment part in a first direction so as to convey the toner toward a communicating port formed at a first side in the attachment and detachment direction. The cleaning member rotates integrally with the case main body in the first direction so as to clean an inner circumferential face of the supplying attachment part.

19 Claims, 14 Drawing Sheets

TONER CASE AND IMAGE FORMING APPARATUS INCLUDING THE SAME

INCORPORATION BY REFERENCE

This application is based on and claims the benefit of priority from Japanese patent application No. 2015-240484 filed on Dec. 9, 2015, which is incorporated by reference in its entirety.

BACKGROUND

The present disclosure relates to a toner case which contains a toner (developer), and an image forming apparatus which includes the toner case.

An electrographic image forming apparatus includes a toner case which supplies a toner to a developing device. The developing device develops a toner image on a surface of a photosensitive drum (image carrier).

There is a case where the image forming apparatus includes a toner cartridge which conveys a toner to a toner discharging port by rotating a bottle part, which contains the toner, around an axis. The toner cartridge is provided with a shutter member which opens and closes the toner discharging port. The toner cartridge is pushed from a near side to a far side of an apparatus main body, and is held by a cartridge holding part. At this time, the shutter member opens the toner discharging port. Incidentally, when the toner cartridge is drawn from the apparatus main body, the shutter member closes the toner discharging port.

SUMMARY

In accordance with the first aspect of the present disclosure, a toner case includes a case main body and a cleaning member. The case main body is capable of containing a toner supplied to an image forming part arranged inside an apparatus main body and is attachable to and detachable from a supplying attachment part of the apparatus main body along an attachment and detachment direction. The cleaning member is arranged at an outer circumferential face of the case main body. The case main body rotates inside the supplying attachment part in a first direction so as to convey the toner toward a communicating port formed at a first side in the attachment and detachment direction. In a state that the cleaning member is in contact with an inner circumferential face of the supplying attachment part, the cleaning member rotates integrally with the case main body in the first direction so as to clean the inner circumferential face of the supplying attachment part.

In accordance with the first aspect of the present disclosure, an image forming apparatus includes the toner case in accordance with the first aspect and the image forming part arranged inside the apparatus main body.

In accordance with the second aspect of the present disclosure, a toner case includes a case main body and a cleaning member. The case main body is capable of containing a toner supplied to an image forming part arranged inside an apparatus main body or a toner discharged from the image forming part and is attachable to and detachable from a supplying attachment part of the apparatus main body or a collecting attachment part of the apparatus main body along an attachment and detachment direction. The cleaning member is arranged at an outer circumferential face of the case main body. The case main body rotates inside the supplying attachment part in a first direction so as to convey the toner toward a supplying port formed at a first side in the attachment and detachment direction. The case main body rotates inside the collecting attachment part in a second direction so as to convey a toner introduced via a collecting port formed at the first side in the attachment and detachment direction toward a second side in the attachment and detachment direction. In a state that the cleaning member is in contact with an inner circumferential face of the supplying attachment part, the cleaning member rotates integrally with the case main body in the first direction so as to clean the inner circumferential face of the supplying attachment part. In a state that the cleaning member is in contact with an inner circumferential face of the collecting attachment part, the cleaning member rotates integrally with the case main body in the second direction so as to clean the inner circumferential face of the collecting attachment part.

In accordance with the second aspect of the present disclosure, an image forming apparatus includes the toner case in accordance with the second aspect and the image forming part arranged inside the apparatus main body.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
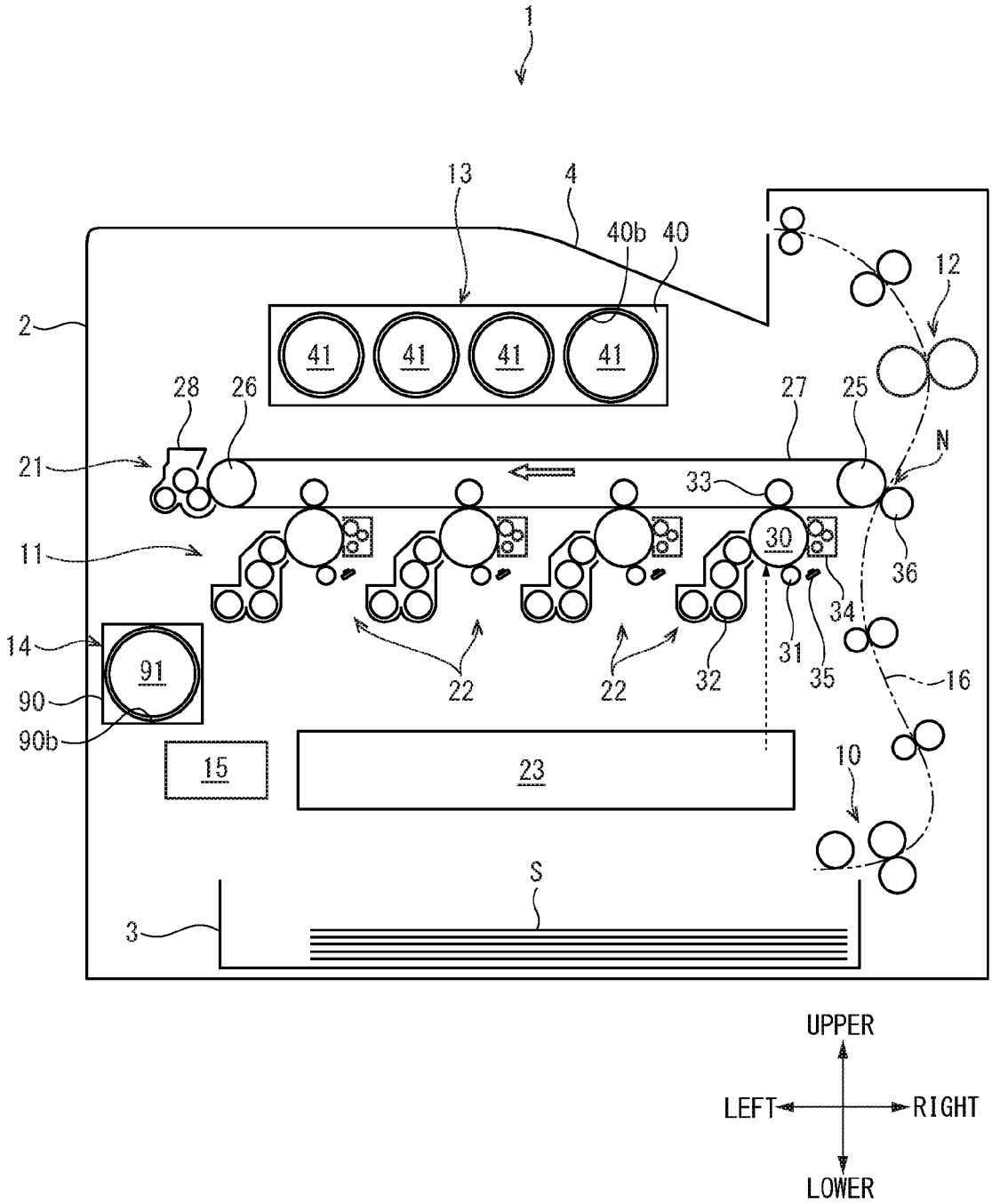
FIG. 1 is a sectional view schematically showing an internal structure of a color printer according to a first embodiment of the present disclosure.
Figure 3:
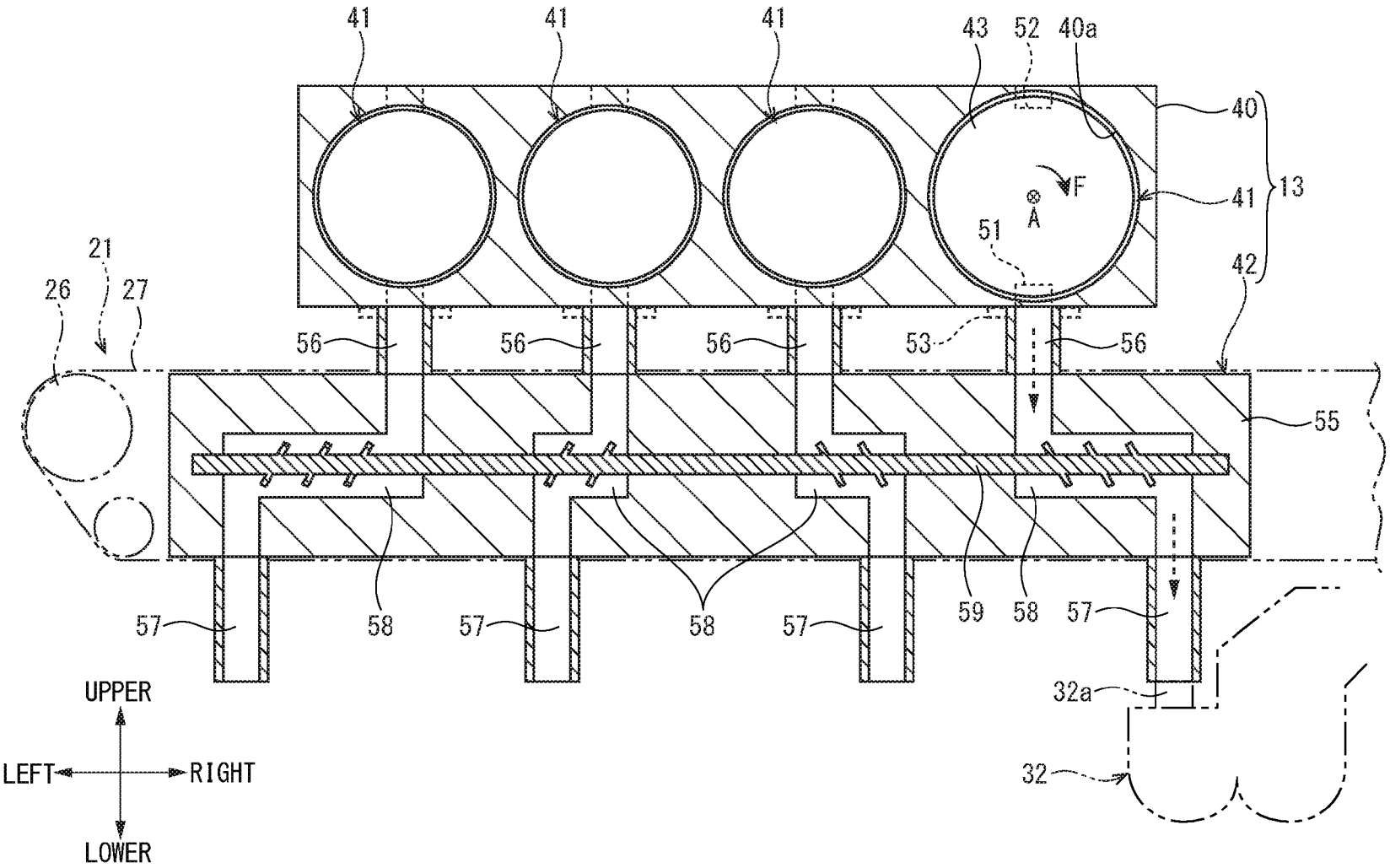
FIG. 3 is a sectional view schematically showing the toner supplying device, in the color printer according to the first embodiment of the present disclosure.
Figure 7:
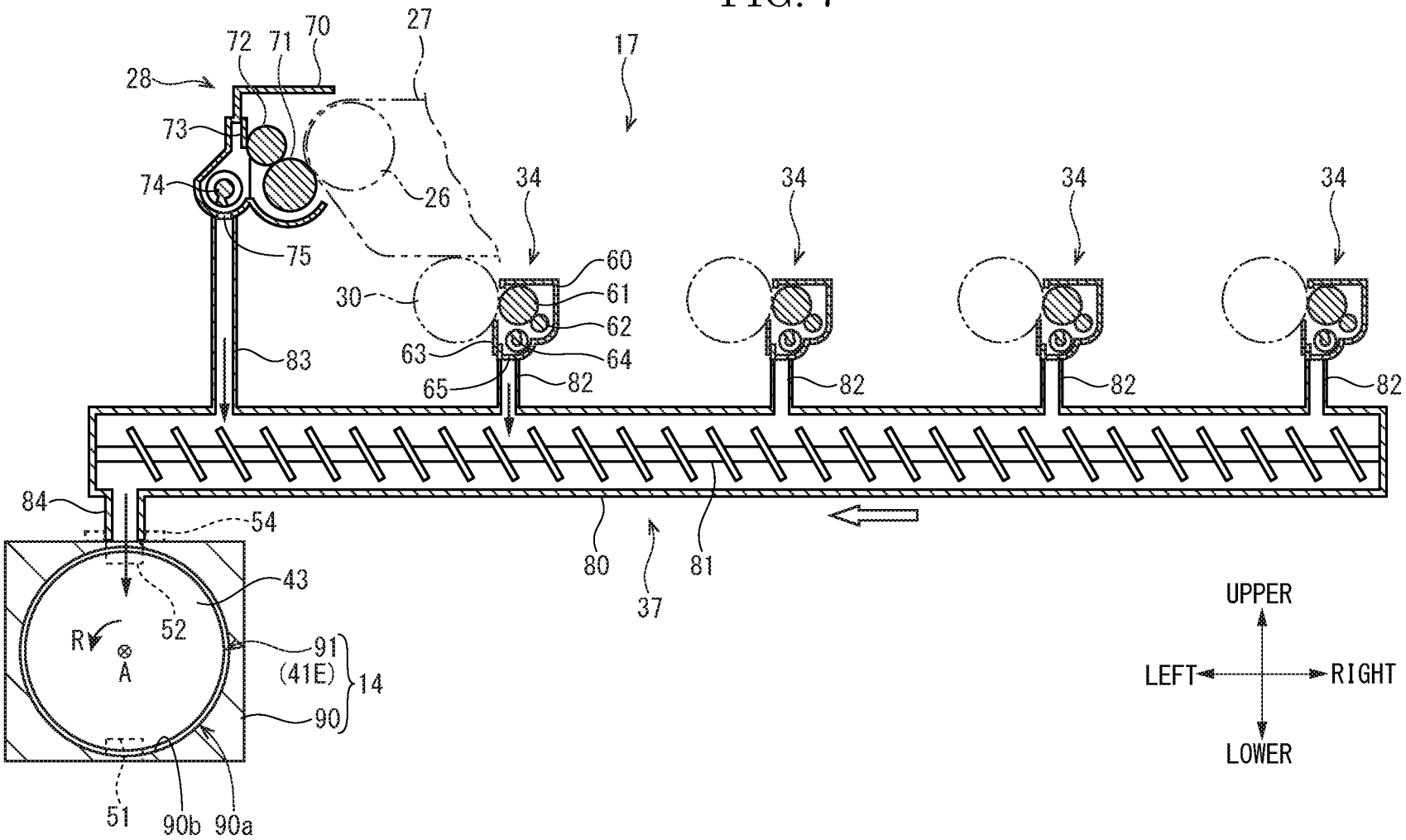
FIG. 7 is a sectional view showing a section along a VII-VII line of FIG. 6.

A preferred embodiment of the present disclosure will be described below with reference to the accompanying drawings. Incidentally, in the following description, a near side in FIGS. 1, 3 and 7 is a front side, and a direction shown in each drawing serves as a reference.

An entire configuration of a color printer 1 as an image forming apparatus according to a first embodiment of the present disclosure will be described with reference to FIG. 1. FIG. 1 is a sectional view schematically showing an internal structure of the color printer 1.

The color printer 1 includes an apparatus main body 2, a sheet feeding cassette 3 and a sheet ejection tray 4. The sheet feeding cassette 3 is attachable to and detachable from a lower part of the apparatus main body 2 of a roughly cuboid shape. In the sheet feeding cassette 3, (a bundle of) sheets S are contained. The sheet ejection tray 4 is arranged at an upper part of the apparatus main body 2. Incidentally, the sheets S are not limited to pieces of paper and may be resin films or OHP sheets.

Further, the color printer 1 includes a sheet feeding part 10, an image forming part 11, a fixing device 12, a toner supplying device 13, a waste toner collecting device 14 and a control device 15, which are housed in the apparatus main body 2. The sheet feeding part 10 is arranged at an upstream side of a conveying path 16 extending from the sheet feeding cassette 3 to the sheet ejection tray 4. The image forming part 11 is arranged at an intermediate part of the apparatus main body 2. The fixing device 12 is arranged at a downstream side of the conveying path 16. The toner supplying device 13 includes four toner cases 41 which contain toners (supply toners) of four colors (yellow, magenta, cyanogen and black). The waste toner collecting device 14 collects a toner (waste toner) which has not been used for image formation. The control device 15 integrally controls each component of the color printer 1. Incidentally, the toner (a developer) may be a two-component developer including the toner and a carrier, or may be a one-component developer including a magnetic toner. Hereinafter, the supply toner and the waste toner are called simply as "toner", in explanations suitable for both of the supply toner and the waste toner.

The image forming part 11 includes an intermediate transfer unit 21, four drum units 22 and an optical scanning device 23. The intermediate transfer unit 21 is arranged below the sheet ejection tray 4. The four drum units 22 are arranged at a lower side of the intermediate transfer unit 21 and aligned in a left and right direction. The optical scanning device 23 is arranged at a lower side of each drum unit 22.

The intermediate transfer unit 21 includes a driving roller 25, a driven roller 26, an intermediate transfer belt 27 and a belt cleaning device 28. The driving roller 25 is arranged at a right side in the apparatus main body 2, and the driven roller 26 is arranged at a left side in the apparatus main body 2. The driving roller 25 is driven by a motor (not shown) to rotate. The intermediate transfer belt 27 as a transferring body is wound around the driving roller 25 and the driven roller 26. The intermediate transfer belt 27 runs circularly and counterclockwise (see an arrow in FIG. 1) when a predetermined tension is applied to the intermediate transfer belt 27 and the driving roller 25 is driven to rotate. The belt cleaning device 28 is arranged at a left side of the driven roller 26.

The four drum units 22 are arranged in association with respective colors of toners. Each drum unit 22 includes a photosensitive drum 30, a charging device 31, a developing device 32, a primary transfer roller 33, a drum cleaning device 34 and a static eliminator 35. Incidentally, the four drum units 22 employ the same configuration, and therefore one drum unit 22 will be described below.

The photosensitive drum 30 as an image carrier is driven by the motor (not shown) to rotate in a state that the photosensitive drum 30 is in contact with a surface at a lower side of the intermediate transfer belt 27. The charging device 31, the developing device 32, the primary transfer roller 33, the drum cleaning device 34 and the static eliminator 35 are arranged around the photosensitive drum 30 in order of a transfer process. The primary transfer roller 33 faces the photosensitive drum 30 from above and across the intermediate transfer belt 27. A secondary transfer roller 36 comes into pressure contact with a right side of the intermediate transfer belt 27 (driving roller 25) so as to form a secondary transfer nip part N.

Hereinafter, an operation of the color printer 1 will be described. The control device 15 executes image formation processing based on inputted image data as follows.

Each charging device 31 charges a surface of each photosensitive drum 30. The optical scanning device 23 performs exposure, which corresponds to the image data, to each photosensitive drum 30 (see a broken line arrow in FIG. 1) so as to form an electrostatic latent image on the surface of each photosensitive drum 30. Each developing device 32 develops the electrostatic latent image, which is formed on the surface of each photosensitive drum 30 by using a supply toner supplied from each toner case 41, to a toner image. Toner images of four colors carried by the four photosensitive drums 30 are primarily transferred to the intermediate transfer belt 27 in order by the primary transfer rollers 33 to which primary transfer biases have been applied. Thus, a full-color toner image is formed on the surface of the intermediate transfer belt 27.

Each sheet S supplied from the sheet feeding cassette 3 is conveyed on the conveying path 16 and passes through the secondary transfer nip part N. The full-color toner image is secondarily transferred to each sheet S by the secondary transfer roller 36 to which a secondary transfer bias has been applied. The fixing device 12 fixes the full-color toner image to each sheet S. Each sheet S after fixing processing is ejected to the sheet ejection tray 4. Each drum cleaning device 34 removes the waste toner (remained toner) remained on the surface of each photosensitive drum 30 after the primary transfer process. Each static eliminator 35 irradiates static eliminating light to remove a charge of each photosensitive drum 30. Further, the belt cleaning device 28 removes the waste toner remained on the surface of the intermediate transfer belt 27 after the secondary transfer process.

Figure 2:
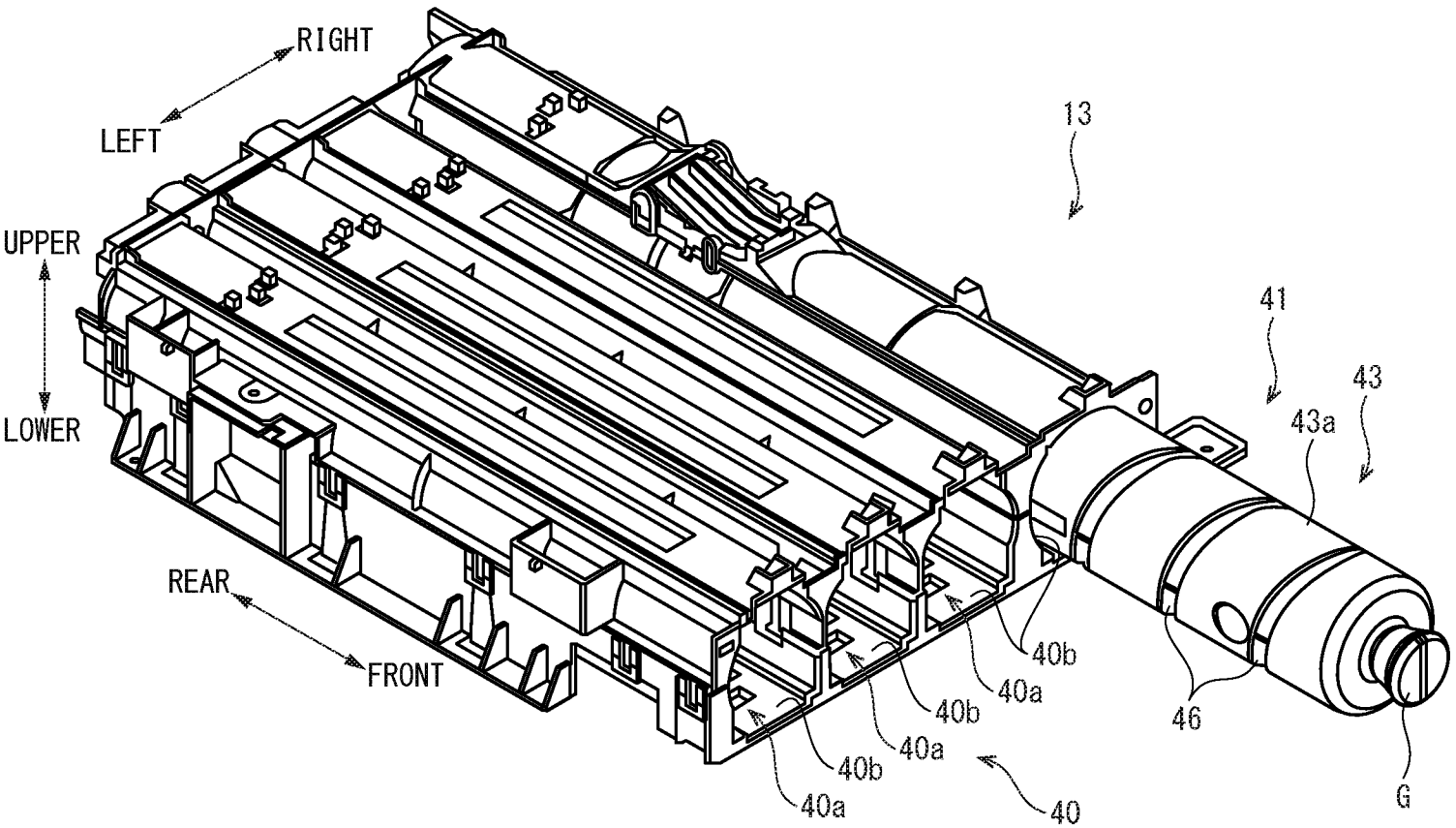
FIG. 2 is a perspective view showing a part of a toner supplying device, in the color printer according to the first embodiment of the present disclosure.
Figure 4:
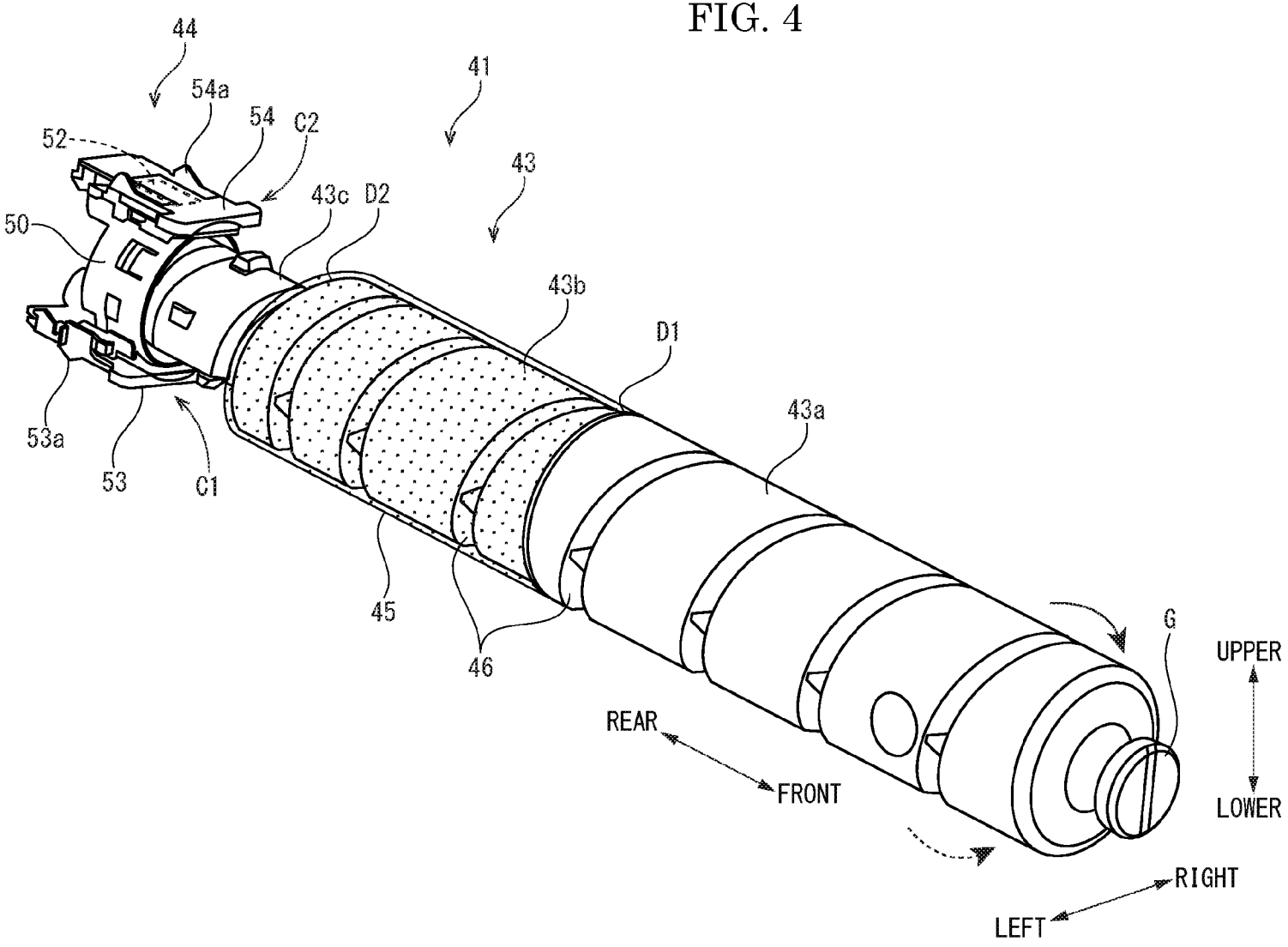
FIG. 4 is a perspective view showing a toner case according to the first embodiment of the present disclosure.
Figure 5:
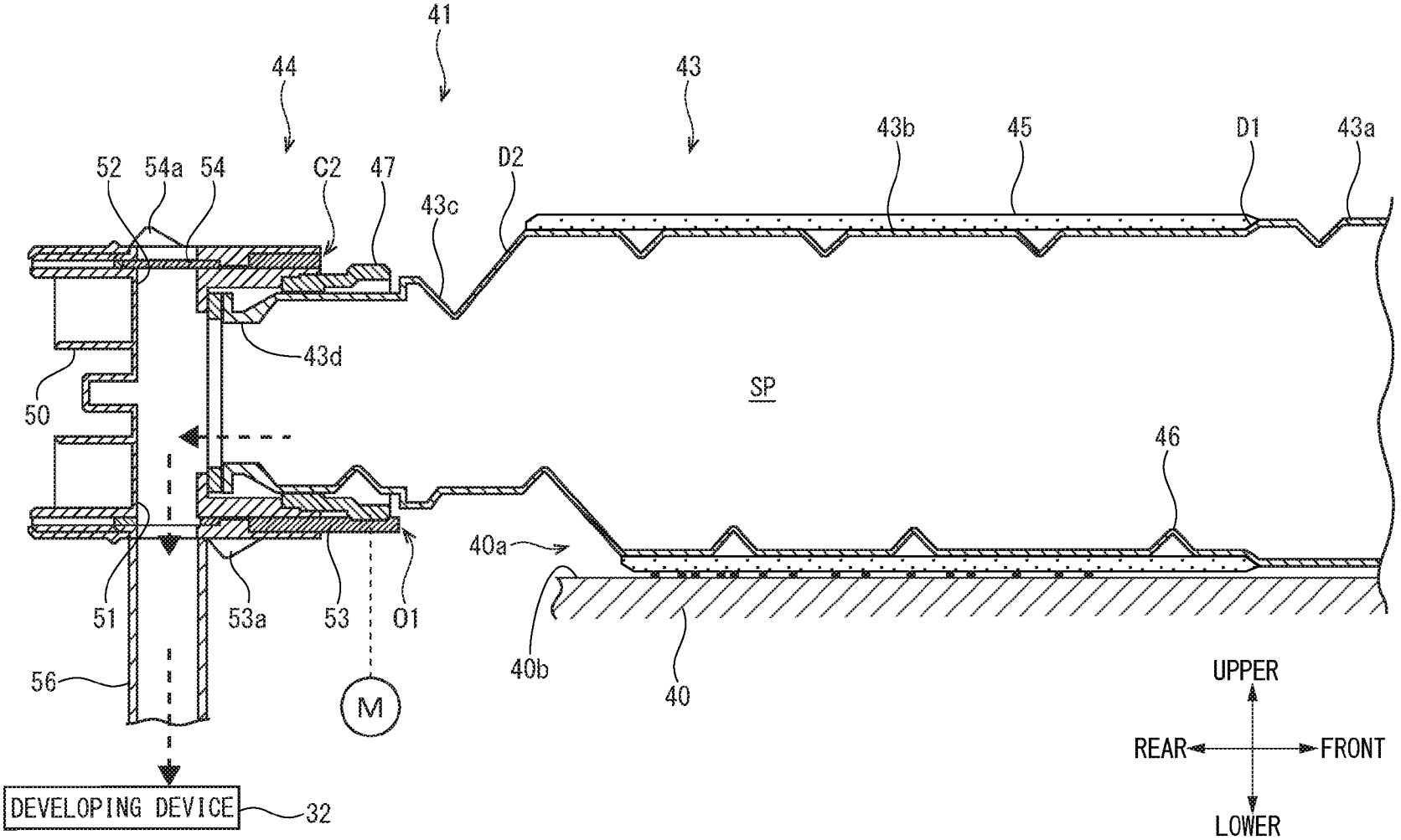
FIG. 5 is a sectional view showing a state that the toner case is attached to a supplying attachment part, according to the first embodiment of the present disclosure.
Figure 6:
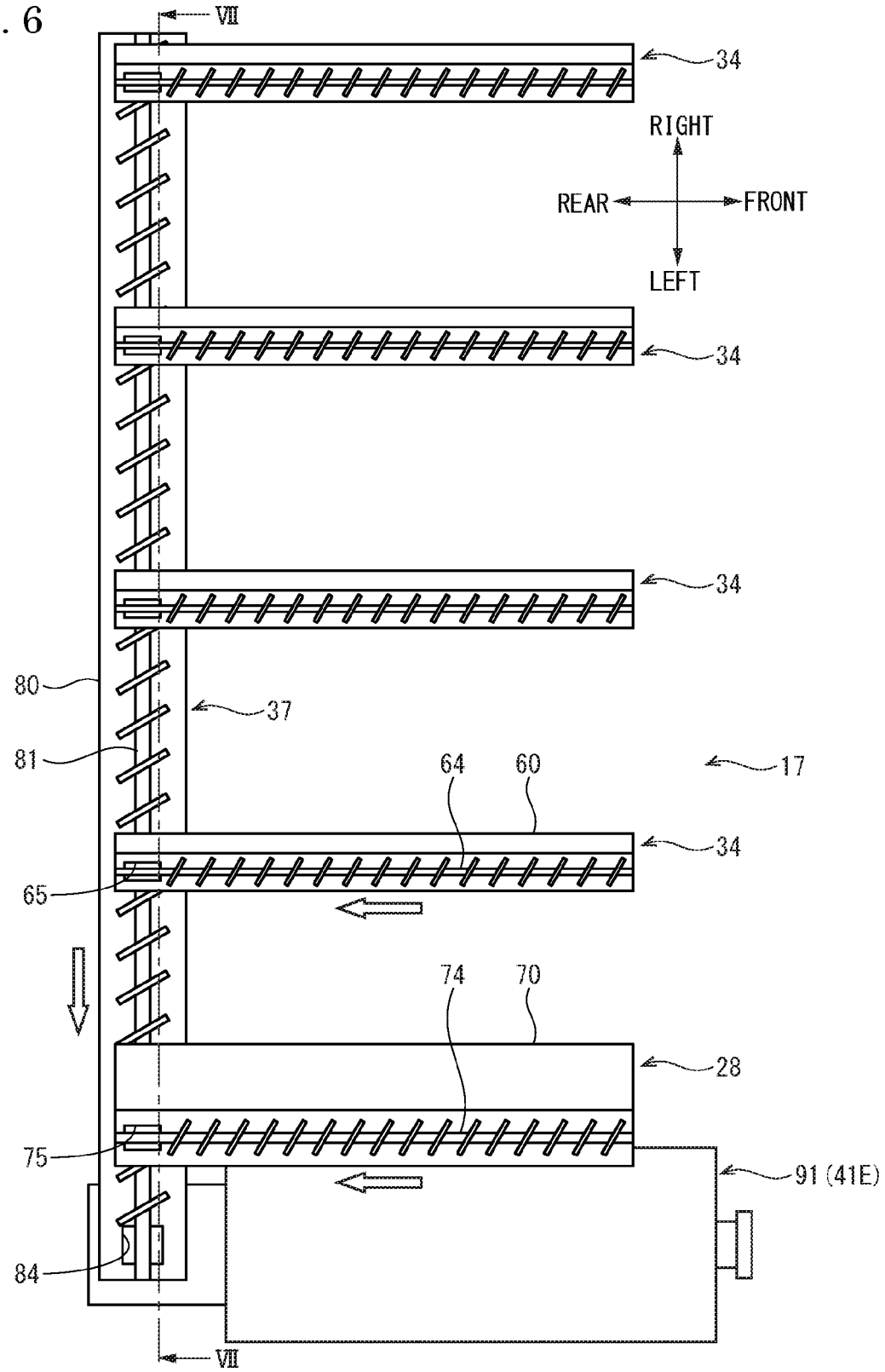
FIG. 6 is a sectional view schematically showing a cleaning structure and a waste toner case, in the color printer according to the first embodiment of the present disclosure.
Figure 8:
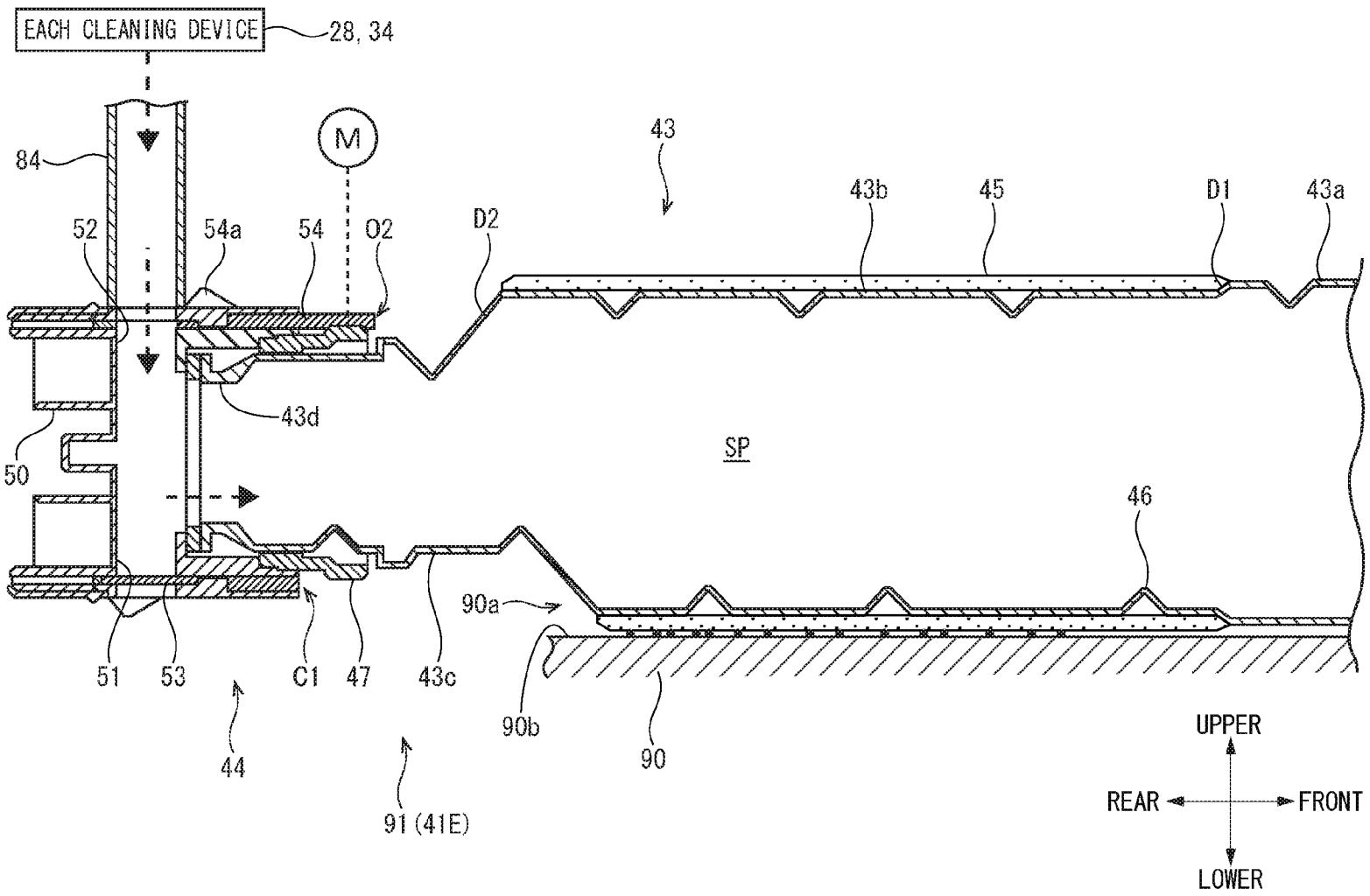
FIG. 8 is a sectional view showing a state that the waste toner case is attached to a collecting attachment part, according to the first embodiment of the present disclosure.

Next, the toner supplying device 13, a cleaning structure 17 and the waste toner collecting device 14 will be described with reference to FIGS. 2 to 8. FIG. 2 is a perspective view showing a part of the toner supplying device 13. FIG. 3 is a sectional view schematically showing the toner supplying device 13. FIG. 4 is a perspective view showing the toner case 41. FIG. 5 is a sectional view showing a state that the toner case 41 is attached to a supplying attachment part 40. FIG. 6 is a sectional view schematically showing the cleaning structure 17 and a waste toner case 91. FIG. 7 is a sectional view showing a section along a VII-VII line of FIG. 6. FIG. 8 is a sectional view showing a state that the waste toner case 91 is attached to a collecting attachment part 90.

As shown in FIGS. 2 and 3, the toner supplying device 13 includes a supplying attachment part 40, the four toner cases 41 and an intermediate conveying part 42.

The supplying attachment part 40 is arranged at the upper part of the apparatus main body 2 (see FIG. 1). In more detail, the supplying attachment part 40 is arranged closer to an upper side than the intermediate transfer unit 21 (each developing device 32). The supplying attachment part 40 includes four supplying space parts 40*a* in which the four toner cases 41 are inserted. The four supplying space parts 40*a* are aligned in the left and right direction. Each supplying space part 40*a* is formed as a space of a roughly columnar shape with an opened front end face. Incidentally, a supplying cover (not shown) which covers a front face of the supplying attachment part 40 (supplying space parts 40*a*) is openable and closable on the apparatus main body 2.

As shown in FIGS. 4 and 5, each toner case 41 includes a case main body 43, a cover member 44, and a cleaning member 45. Each toner case 41 (case main body 43) is attachable to and detachable from the supplying attachment part 40 (supplying space parts 40*a*) in the apparatus main body 2 along a front and rear direction as an attachment and detachment direction (see FIG. 2). The toner case 41 for the black toner is attached to the supplying space part 40*a* at a right end, and this toner case 41 is formed to be thicker (with a larger diameter) than the other toner cases 41. However, the four toner cases 41 employ the same configuration except the diameters, and therefore the black toner case 41 will be described below. Incidentally, the toner cases 41 will be described based on a posture in which the toner case 41 is attached to the supplying attachment part 40.

The case main body 43 is formed in a roughly cylindrical shape elongated in the front and rear direction as the attachment and detachment direction. The case main body 43 is formed by using a synthetic resin material, such as a PET resin (polyethylene terephthalate). A containing space SP is formed inside the case main body 43. The case main body 43 contains a supply toner supplied to the developing device 32 (image forming part 11).

The case main body 43 is integrally formed by a large diameter cylinder part 43*a*, a small diameter cylinder part 43*b* and a cover attachment part 43*c* (cylindrical piece). The large diameter cylinder part 43*a* is formed in a roughly cylindrical shape with a closed front end face. A grip part G is protruded on the front end face of the large diameter cylinder part 43*a*. The small diameter cylinder part 43*b* is formed in a roughly cylindrical shape thinner (having smaller diameter) than the large diameter cylinder part 43*a*. The small diameter cylinder part 43*b* is extended backward from a rear end face of the large diameter cylinder part 43*a*. A first stepped part D1 is formed between the small diameter cylinder part 43*b* and the large diameter cylinder part 43*a*. The cover attachment part 43*c* is formed in a roughly cylindrical shape thinner (having smaller diameter) than the small diameter cylinder part 43*b*. The cover attachment part 43*c* extends backward from a rear end face of the small diameter cylinder part 43*b*. A second stepped part D2 is formed between the cover attachment part 43*c* and the small diameter cylinder part 43*b*. An opening part 43*d* is opened on a rear end face of the cover attachment part 43*c* (see FIG. 5).

A conveying rib 46 is formed integrally with a surrounding wall of the case main body 43 along the front and rear direction. The conveying rib 46 is spirally protruded on an inner circumferential face of the case main body 43 toward an axial center (inside). Incidentally, the case main body 43 and the conveying rib 46 are formed with a substantially identical thickness. Although described in detail below, the conveying rib 46 has a function of conveying a supply toner toward the opening part 43*d* (backward) by rotating the case main body 43. Incidentally, although the conveying rib 46 is formed integrally with the case main body 43, the present disclosure is not limited to this and the conveying rib and the case main body may be composed of different members.

As shown in FIG. 5, a transmission gear 47 (transmission member) of a roughly annular shape is fixed to a rear part (at a side of the opening part 43*d*) of an outer circumferential face of the cover attachment part 43*c*. The transmission gear 47 is connected with a driving motor M (driving source) via a power transmitting mechanism (not shown), such as a shaft and a gear.

As shown in FIGS. 4 and 5, the cover member 44 includes a housing frame 50, a supplying port 51, a collecting port 52, a supplying shutter 53 and a collecting shutter 54. The supplying port 51 is formed to discharge the supply toner from an inside of the housing frame 50 to the image forming part 11 (developing device 32). The collecting port 52 is formed to introduce the waste toner, which is remained without being used for image formation, from the image forming part 11 (each cleaning device 28 and 34) to the inside of the housing frame 50. The supplying shutter 53 is arranged to open and close the supplying port 51. The collecting shutter 54 is arranged to open and close the collecting port 52.

The housing frame 50 is formed in a roughly cylindrical shape with a closed rear end face. The housing frame 50 is arranged to cover the opening part 43*d* at a position closer to a rear side than the transmission gear 47. The housing frame 50 engages with a rear end part of the cover attachment part 43*c* from an outside in a radial direction. The housing frame 50 communicates with an inside (containing space SP) of the case main body 43. The housing frame 50 supports the cover attachment part 43*c* (case main body 43) rotatably in a circumferential direction.

As shown in FIG. 5, the supplying port 51 and the collecting port 52 are openings of roughly rectangular shapes which penetrate the surrounding wall (circumferential face) of the housing frame 50. The supplying port 51 and the collecting port 52 are formed in an identical shape. The supplying port 51 and the collecting port 52 communicate an inside and an outside of the case main body 43. The supplying port 51 is opened on a circumferential face of a lower side of the housing frame 50. The collecting port 52 is opened on a circumferential face at an upper side of the housing frame 50. The supplying port 51 and the collecting port 52 are formed so as to face each other in the circumferential direction of the case main body 43 (housing frame 50). That is, the collecting port 52 is formed so as to be shifted 180 degrees from the supplying port 51 in the circumferential direction.

The supplying shutter 53 and the collecting shutter 54 are slidable in the front and rear direction with respect to the housing frame 50. More specifically, the supplying shutter 53 is slidable between an opening position O1 to open the supplying port 51 and a closing position C1 (see FIG. 8) to close the supplying port 51. Similarly, the collecting shutter 54 is slidable between an opening position O2 (see FIG. 8) to open the collecting port 52 and a closing position C2 to close the collecting port 52. The supplying shutter 53 and the collecting shutter 54 are formed so as to face each other in the circumferential direction of the case main body 43 (housing frame 50).

The supplying shutter 53 and the collecting shutter 54 are formed in a substantially identical shape. More specifically, the supplying shutter 53 and the collecting shutter 54 are formed in roughly plate shapes. A pair of left and right protrusion parts 53*a* are protruded on a lower face of the supplying shutter 53 (an opposite face of the supplying port 51). Similarly, a pair of left and right protrusion parts 54*a* are protruded on an upper face of the collecting shutter 54 (an opposite face of the collecting port 52).

The cleaning member 45 is formed in a cylindrical shape by rolling a pile material of a rectangular sheet, for example. The cleaning member 45 is arranged to cover an outer circumferential face of the case main body 43. In more detail, the cleaning member 45 is cylindrically wound around an outer circumferential face of the small diameter cylinder part 43*b*. The cleaning member 45 is fixed to the outer circumferential face of the small diameter cylinder part 43*b* by an adhesive or a double-sided tape, for example. A thickness of the cleaning member 45 is slightly greater than the thickness of the first stepped part D1. That is, an outer diameter of the cleaning member 45 is slightly larger than an outer diameter of the large diameter cylinder part 43*a*. Consequently, the cleaning member 45 can appropriately clean inner circumferential faces of the supplying attachment part 40 and the collecting attachment part 90. Incidentally, the cleaning member 45 may be composed of not the pile material but a nonwoven fabric or a brush formed by planting resin brush bristles.

As shown in FIG. 3, the intermediate conveying part 42 is arranged between each toner case 41 and each developing device 32. The intermediate conveying part 42 includes an intermediate housing 55, four intermediate supplying pipes 56, four intermediate discharging pipes 57, four intermediate conveying paths 58 and an intermediate conveying screw 59.

The intermediate housing 55 is formed in a roughly cuboid shape, and is arranged inside the intermediate transfer belt 27. The four intermediate supplying pipes 56 are aligned in the left and right direction on an upper face at a rear side of the intermediate housing 55. Each intermediate supplying pipe 56 is formed so as to correspond to each supplying port 51 of each toner case 41 attached to the supplying attachment part 40. The four intermediate discharging pipes 57 are aligned in the left and right direction on a lower face at the rear side of the intermediate housing 55. Each intermediate discharging pipe 57 is connected with an introducing port 32*a* opened upward on the developing device 32. The four intermediate conveying paths 58 are formed in roughly crank shapes inside the intermediate housing 55. Each intermediate conveying path 58 communicates each intermediate supplying pipe 56 and each intermediate discharging pipe 57. The intermediate conveying screw 59 is supported so as to penetrate horizontal parts of all intermediate conveying paths 58. The intermediate conveying screw 59 includes spiral fins on a circumferential face of a rotation axis extending in the left and right direction. The intermediate conveying screw 59 is driven by the motor (not shown) to rotate.

Hereinafter, a process of attaching the toner case 41 to the supplying attachment part 40 will be described. Incidentally, in a state that the toner case 41 is detached from the supplying attachment part 40, the supplying shutter 53 is displaced to the closing position C1, and the collecting shutter 54 is displaced to the closing position C2 (see FIG. 4).

A user opens the supplying cover of the apparatus main body 2, and pushes the toner case 41 (case main body 43) backward from a front face of the supplying space part 40*a* with the grip part G placed at the near side and in a posture in which the supplying port 51 is oriented downward (see FIG. 2). In the process of pushing the toner case 41 in the supplying space part 40*a*, each protrusion part 53*a* of the supplying shutter 53 comes into contact with (interferes with) each engagement part (not shown) arranged at the supplying attachment part 40. When the toner case 41 is further pushed, the supplying shutter 53 slides relatively forward. According to this, the supplying shutter 53 moves from the closing position C1 to the opening position O1 (see FIG. 5). That is, the supplying port 51 is opened. Further, when the supplying cover is closed, an operation of attaching each toner case 41 is finished.

The case main body 43 is rotatably supported inside the supplying space part 40*a* in the state that the case main body 43 (toner case 41) is attached to the supplying attachment part 40. Meanwhile, in this state, the cover member 44 is supported inside the supplying space part 40*a* so that the cover member 44 is not rotatable. Further, in this state, the supplying port 51 is opened downward and is connected with the intermediate supplying pipe 56 (see FIG. 3). That is, the supplying port 51 of the toner case 41 is connected with the introducing port 32*a* of the developing device 32 (image forming part 11) via the intermediate conveying part 42. Incidentally, the collecting shutter 54 closes each collecting port 52 (the collecting shutter 54 is displaced to the closing position C2) in the state that the case main body 43 is attached to the supplying attachment part 40 (see FIG. 5).

As shown in FIG. 5, in this state, the transmission gear 47 of the toner case 41 is connected with the driving motor M via the power transmitting mechanism. The transmission gear 47 transmits a driving force (rotation force) from the driving motor M to the case main body 43. Inside the supplying attachment part 40, the case main body 43 rotates clockwise (in a first direction) around a rotation axis A extending in the front and rear direction (see an arrow F in FIG. 3). The conveying rib 46 also rotates clockwise integrally with the case main body 43. The conveying rib 46 (case main body 43) rotates clockwise so as to convey a supply toner toward the supplying port 51 formed at a rear side (a first side in the attachment and detachment direction) (see a broken line arrow in FIG. 5). Further, the cleaning member 45 rotates clockwise with the case main body 43 in a state that the cleaning member 45 is in contact with an inner circumferential face 40*b* of the supplying attachment part 40 which forms the supplying space part 40*a*.

The supply toner is discharged from the supplying port 51, passes through the intermediate supplying pipe 56 and enters the intermediate conveying path 58 (see a broken line arrow in FIG. 3). The intermediate conveying screw 59 is driven by the motor to rotate, and conveys the supply toner in the intermediate conveying path 58 toward the intermediate discharging pipe 57. The supply toner passes through the intermediate discharging pipe 57 and is supplied (refilled) from the introducing port 32*a* to the developing device 32 (see the broken line arrow in FIG. 3). Incidentally, even when the case main body 43 rotates as mentioned above, the cover member 44 does not rotate and maintains a rotation stop state.

Next, a process of detaching the toner case 41 from the supplying attachment part 40 will be described. The user opens the supplying cover of the apparatus main body 2, grips the grip part G and draws each toner case 41 toward the near side (see FIG. 2). In accordance with drawing (detaching operation) of each toner case 41, the transmission gear 47 and the driving motor M are disconnected. Further, in accordance with the detaching operation of each toner case 41, a biasing member (not shown) arranged in the supplying space part 40*a* biases the supplying shutter 53 backward. According to this, the supplying shutter 53 moves from the opening position O1 to the closing position C1 (see FIG. 4).

That is, the supplying port 51 is closed. Further, when the toner case 41 is completely drawn, the detaching operation is finished. As mentioned above, the supplying shutter 53 opens the supplying port 51 in accordance with attachment of the case main body 43 to the supplying attachment part 40, and closes the supplying port 51 in accordance with detachment of the case main body 43 from the supplying attachment part 40.

In this regard, the supply toner may leak a little via the supplying port 51 when the toner case 41 is attached to or detached from the supplying attachment part 40 (when the toner case 41 is exchanged). The leaked supply toner adheres to (accumulates at) a lower part of the inner circumferential face 40*b* of the supplying attachment part 40. Hence, the toner case 41 according to the first embodiment includes the cleaning member 45 which cleans the inner circumferential face 40*b* of the supplying attachment part 40.

As mentioned above, the cleaning member 45 rotates clockwise integrally with the case main body 43 in the state that the cleaning member 45 is in contact with the inner circumferential face 40*b* of the supplying attachment part 40. Thus, the cleaning member 45 rotates with the case main body 43 attached to the supplying attachment part 40, and slides on the inner circumferential face 40*b* of the supplying attachment part 40. Further, the cleaning member 45 wipes the supply toner on the inner circumferential face 40*b* of the supplying attachment part 40. More accurately, the cleaning member 45 holds this supply toner. Thus, it is possible to clean the inner circumferential face 40*b* of the supplying attachment part 40, and prevent the toner from contaminating the apparatus main body 2.

Further, the cleaning member 45 holds the supply toner wiped (cleaned) from the inner circumferential face 40*b* of the supplying attachment part 40. Consequently, it is possible to prevent the cleaned supplying attachment part 40 from being contaminated by the toner again.

Next, as shown in FIGS. 6 and 7, the cleaning structure 17 includes the above-mentioned four drum cleaning devices 34, the above-mentioned belt cleaning device 28 and a discharging conveying device 37.

The four drum cleaning devices 34 are arranged in association with the four photosensitive drums 30 (see FIG. 1). Incidentally, the four drum cleaning devices 34 employ the same configuration, and therefore one drum cleaning device 34 will be described below.

As shown in FIG. 7, the drum cleaning device 34 includes a drum-side housing 60, a polishing roller 61, a restricting roller 62, a cleaning blade 63 and a drum-side screw 64.

The drum-side housing 60 is formed in a roughly box shape elongated in the front and rear direction (see FIG. 6). An opening is formed on a left face (a face facing the photosensitive drum 30) of the drum-side housing 60.

The polishing roller 61 and the restricting roller 62 are formed in roughly cylindrical shapes elongated in the front and rear directions. The polishing roller 61 and the restricting roller 62 are supported rotatably around axes in the drum-side housing 60. A part of the polishing roller 61 is exposed through the opening of the drum-side housing 60, and is in contact with the photosensitive drum 30. The restricting roller 62 is in contact with a lower right side of the polishing roller 61. The cleaning blade 63 is formed in a plate shape by using a synthetic resin, for example, and is fixed to the drum-side housing 60. A distal end part of the cleaning blade 63 is in contact with the photosensitive drum 30.

The drum-side screw 64 has a spiral fin on a circumferential face of a rotation axis extending in the front and rear direction (see FIG. 6). The drum-side screw 64 is supported rotatably around an axis in the drum-side housing 60. The drum-side screw 64 is disposed at a lower left part of the drum-side housing 60. A drum-side discharging port 65 connected with the discharging conveying device 37 is opened on a rear bottom face of the drum-side housing 60 (see FIG. 6). Incidentally, the polishing roller 61 rotates with the photosensitive drum 30, and the restricting roller 62 rotates with the polishing roller 61. The drum-side screw 64 is driven by a motor (not shown) to rotate. Incidentally, the present disclosure is not limited to the above, and the polishing roller 61 and the restricting roller 62 may be driven by the motor to rotate.

Figure 10:
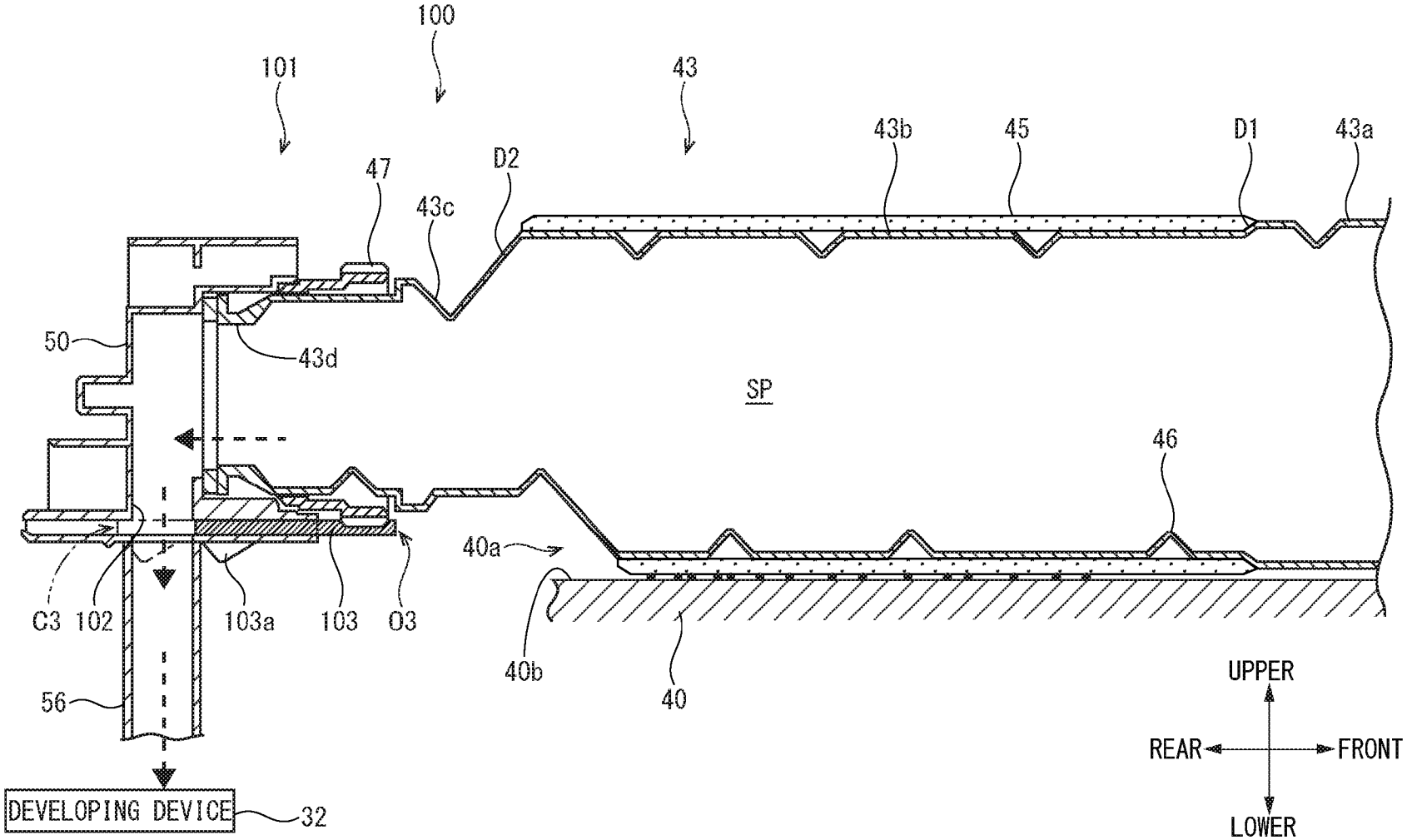
FIG. 10 is a sectional view showing a state that a toner case is attached to a supplying attachment part, according to a second embodiment of the present disclosure.

Next, as shown in FIG. 10, the belt cleaning device 28 includes a belt-side housing 70, a bias brush 71, a collecting roller 72, a collecting blade 73 and a belt-side screw 74.

The belt-side housing 70 is formed in a roughly box shape elongated in the front and rear direction (see FIG. 6). An opening is formed on a right face (a face facing the intermediate transfer belt 27) of the belt-side housing 70.

The bias brush 71 and the collecting roller 72 are formed in roughly cylindrical shapes elongated in the front and rear direction. The bias brush 71 and the collecting roller 72 are supported rotatably around axes in the belt-side housing 70. A part of the bias brush 71 is exposed through the opening of the belt-side housing 70, and is in contact with the intermediate transfer belt 27. The collecting roller 72 is in contact with an upper left side of the bias brush 71. The collecting blade 73 is formed in a plate shape by using a synthetic resin, for example, and is fixed to the belt-side housing 70. A distal end part of the collecting blade 73 is in contact with the collecting roller 72.

The belt-side screw 74 includes a spiral fin on a circumferential face of a rotation axis extending in the front and rear direction (see FIG. 6). The belt-side screw 74 is supported rotatably around an axis in the belt-side housing 70. The belt-side screw 74 is arranged at a lower left part of the belt-side housing 70. A belt-side discharging port 75 connected with the discharging conveying device 37 is opened on a bottom face at a rear side of the belt-side housing 70 (see FIG. 6). Incidentally, the bias brush 71, the collecting roller 72 and the belt-side screw 74 are rotated by a motor (not shown) to rotate.

As shown in FIGS. 6 and 7, the discharging conveying device 37 includes a conveying housing 80 and a conveying screw 81. The discharging conveying device 37 conveys a toner removed by each drum cleaning device 34 and the belt cleaning device 28 toward the waste toner collecting device 14.

The conveying housing 80 is formed in a cuboid shape elongated in the left and right direction. Four drum-side introducing pipes 82 and a belt-side introducing pipe 83 are aligned in the left and right direction on an upper face of the conveying housing 80. The four drum-side introducing pipes 82 are connected with the drum-side discharging ports 65 of the drum cleaning devices 34. The belt-side introducing pipe 83 is connected with the belt-side discharging port 75 of the belt cleaning device 28. A conveying discharging pipe 84 connected with the waste toner collecting device 14 is formed on a bottom face at a left side of the conveying housing 80.

The conveying screw 81 includes a spiral fin on a circumferential face of a rotation axis extending in the left and right direction. The conveying screw 81 is supported rotatably around an axis in the conveying housing 80. The conveying screw 81 is driven by a motor (not shown) to rotate. Incidentally, the bias brush 71, each drum-side screw 64, the belt-side screw 74 and the conveying screw 81 are connected with a bias power supply which applies a bias of an inverse polarity from a charging polarity (positive charge) of the toner.

Next, a function (toner removing operation) of the cleaning structure 17 will be described. Incidentally, in the following description, the bias power supply is controlled by the control device 15, and applies a bias of a negative polarity to the bias brush 71 and each of the screws 64, 74 and 81.

First, a function of the drum cleaning device 34 will be described. When the above-mentioned image formation processing is executed, the polishing roller 61 and the restricting roller 62 rotate with the photosensitive drum 30. The drum-side screw 64 is driven by the motor to rotate.

A waste toner (remained toner) remained on the surface of the photosensitive drum 30 adheres to a surface of the polishing roller 61 so as to form a toner layer. The polishing roller 61 polishes the surface of the photosensitive drum 30 via the toner layer. The restricting roller 62 makes a layer thickness of the toner layer uniform. The cleaning blade 63 scrapes the remained toner adhered to the surface of the photosensitive drum 30. The waste toner removed from the photosensitive drum 30 is introduced into the drum-side housing 60. The drum-side screw 64 conveys the waste toner in the drum-side housing 60 toward the drum-side discharging port 65 (see an arrow in FIG. 6). The waste toner is discharged via the drum-side discharging port 65 opened downward, passes through the drum-side introducing pipe 82 and enters the conveying housing 80 (see an arrow in FIG. 7).

Next, a function of the belt cleaning device 28 will be described. When the image formation processing is executed, the bias brush 71, the collecting roller 72 and the belt-side screw 74 are driven by the motor to rotate.

The bias brush 71 adsorbs the waste toner (remained toner) adhered to the surface of the intermediate transfer belt 27 by an electrostatic adsorbing force. The collecting roller 72 receives the waste toner having moved to the bias brush 71. The collecting blade 73 scrapes the waste toner having moved to the collecting roller 72. The waste toner removed from the collecting roller 72 is introduced into the belt-side housing 70. The belt-side screw 74 conveys the waste toner in the belt-side housing 70 toward the belt-side discharging port 75 (see an arrow in FIG. 6). The waste toner is discharged via the belt-side discharging port 75 opened downward, passes through the belt-side introducing pipe 83 and enters the conveying housing 80 (see an arrow in FIG. 7).

The waste toner having entered the conveying housing 80 is conveyed toward the conveying discharging pipe 84 by driving the conveying screw 81 to rotate (see an arrows in FIG. 7).

Next, as shown in FIGS. 6 to 8, the waste toner collecting device 14 includes a collecting attachment part 90 and a waste toner case 91.

The collecting attachment part 90 is arranged at a left side of an intermediate part of the apparatus main body 2 (see FIG. 1). In more detail, the collecting attachment part 90 is arranged closer to a lower side than each of the cleaning devices 28 and 34. The collecting attachment part 90 includes a collecting space part 90*a* in which the waste toner case 91 is inserted. The collecting space part 90*a* is formed as a space of a roughly columnar shape with an opened front end face. The collecting space part 90*a* is formed so as to correspond to the conveying discharging pipe 84 of the discharging conveying device 37. Incidentally, a collecting cover (not shown) which covers a front face of the collecting space part 90*a* is openable and closable on the apparatus main body 2.

The waste toner case 91 is one of the four toner cases 41 (which is also referred to as an "empty case 41E" below) which has consumed a supply toner and becomes empty. That is, the one empty case 41E is used (reused) for the waste toner case 91, too, for collecting the waste toner. Incidentally, the waste toner case 91 has a shape identical to the shape of each toner case 41 mentioned above, and therefore the waste toner case 91 will not be described in detail. Further, the same components as those of each toner case 41 will be assigned the same reference numerals.

The waste toner case 91 (case main body 43) is attachable to and detachable from the collecting attachment part 90 (collecting space part 90*a*) in the apparatus main body 2. The case main body 43 of the waste toner case 91 contains the waste toner discharged from each of the cleaning devices 28 and 34 (image forming part 11).

Hereinafter, a process of attaching the waste toner case 91 to the collecting attachment part 90 will be described. The user opens the supplying cover of the apparatus main body 2, and detaches the toner case 41 (empty case 41E), which has consumed the supply toner and becomes empty, from the supplying attachment part 40. The supplying shutter 53 of the empty case 41E having been detached from the supplying attachment part 40 is displaced to the closing position C1, and the collecting shutter 54 is displaced to the closing position C2 (see FIG. 4).

Next, the user opens the collecting cover of the apparatus main body 2, and moves the empty case 41E, which has been detached from the supplying attachment part 40, to a position in front of the collecting attachment part 90. The user pushes the empty case 41E (case main body 43) backward from the front face of the collecting space part 90*a* in a posture in which the collecting port 52 is oriented upward (the supplying port 51 is oriented downward). That is, the case main body 43 is attached to the collecting attachment part 90 in a posture identical to a posture in which the case main body 43 is attached to the supplying attachment part 40. Consequently, for example, even the user who is not used to performing an exchanging operation can easily perform the exchanging operation and prevents an erroneous operation, too.

In the process of pushing the empty case 41E (waste toner case 91) in the collecting space part 90*a*, each protrusion part 54*a* of the collecting shutter 54 contacts (interferes with) the engagement part (not shown) arranged at the collecting attachment part 90. When the waste toner case 91 is further pushed, the collecting shutter 54 slides from the closing position C2 to the opening position O2 (see FIG. 8). That is, the collecting port 52 is opened. Further, when the collecting cover is closed, the operation of attaching the waste toner case 91 is finished.

Incidentally, although not shown and described in detail, the toner case 41 (waste toner case 91), the supplying attachment part 40 and the collecting attachment part 90 are provided with an erroneous attachment preventing mechanism (not shown). This erroneous attachment preventing mechanism prevents the waste toner case 91 from being attached again to the supplying attachment part 40.

The case main body 43 is supported rotatably inside the collecting space part 90*a* in a state that the case main body 43 (waste toner case 91) is attached to the collecting attachment part 90. Meanwhile, in this state, the cover member 44 is supported inside the collecting space part 90*a* so that the cover member 44 is not rotatable. Further, in this state, the collecting port 52 is opened upward and is connected with the conveying discharging pipe 84 (see FIGS. 7 and 8). That is, the collecting port 52 of the waste toner case 91 is connected with each of the discharging ports 65 and 75 of each of the cleaning devices 28 and 34 (image forming part 11) via the discharging conveying device 37. Incidentally, the supplying shutter 53, which is displaced to the closing position C1, closes the supplying port 51 in the state that the case main body 43 is attached to the collecting attachment part 90 (see FIG. 8).

Further, in this state, the transmission gear 47 of the waste toner case 91 is connected with the driving motor M via the shaft and the gear. In the collecting attachment part 90, the case main body 43 is driven by the driving motor M to rotate counterclockwise (in a second direction) around the rotation axis A (see an arrow R in FIG. 7). The conveying rib 46 rotates counterclockwise integrally with the case main body 43. That is, the case main body 43 or the like rotates in a reverse direction to a direction in which the case main body 43 rotates when the case main body 43 is attached to the supplying attachment part 40.

The waste toner in the conveying housing 80 passes through the conveying discharging pipe 84, and enters the case main body 43 via the collecting port 52 (see the arrow in FIG. 7). The conveying rib 46 (case main body 43) rotates counterclockwise so as to convey the waste toner introduced via the collecting port 52, which is formed at the rear side (the first side in the attachment and detachment direction), to the front side (the second side in the attachment and detachment direction) (see a broken line arrow in FIG. 8). The conveying rib 46 makes a surface of the waste toner stored in the containing space SP even while conveying the waste toner in a direction (forward) remote from the opening part 43*d*. In this way, the waste toner is collected in the waste toner case 91 (case main body 43). Further, the cleaning member 45 rotates counterclockwise with the case main body 43 in a state that the cleaning member 45 is in contact with an inner circumferential face 90*b* of the collecting attachment part 90 which forms the collecting space part 90*a*.

Incidentally, the collecting attachment part 90 is provided with a sensor (not shown) which detects the waste toner case 91 is full of the waste toner. When the sensor detects that the waste toner case 91 is full, the control device 15 controls a liquid crystal display or a speaker (not shown) to notify the user of an exchange of the waste toner case 91.

To detach the waste toner case 91 from the collecting attachment part 90, the user needs to open the collecting cover of the apparatus main body 2, and to grip the grip part G and draw the waste toner case 91 toward the near side. In accordance with drawing of the toner case 41, the transmission gear 47 and the driving motor M are disconnected, and the collecting shutter 54 moves from the opening position O2 to the closing position C2 (see FIG. 6). As mentioned above, the collecting shutter 54 opens the collecting port 52 in accordance with attachment of the case main body 43 to the collecting attachment part 90, and closes the collecting port 52 in accordance with detachment of the case main body 43 from the collecting attachment part 90.

In this regard, similar to a supply side, the waste toner may leak a little via the collecting port 52 during exchange of the empty case 41E (waste toner case 91) from the collecting attachment part 90. The leaked waste toner adheres to (accumulates at) a lower part of the inner circumferential face 90*b* of the collecting attachment part 90.

In this regard, the cleaning member 45 rotates counterclockwise integrally with the case main body 43 in the state that the cleaning member 45 is in contact with the inner circumferential face 90*b* of the collecting attachment part 90 so as to clean the inner circumferential face 90*b* of the collecting attachment part 90. The cleaning member 45 holds the collected waste toner. Thus, the cleaning member 45 rotates with the case main body 43 attached to the collecting attachment part 90, and slides on the inner circumferential face 90*b* of the collecting attachment part 90 (wipes the waste toner). Consequently, it is possible to clean the inner circumferential face 90*b* of the collecting attachment part 90, and prevent the toner from contaminating the apparatus main body 2. Further, the cleaning member 45 holds the wiped waste toner, so that it is possible to prevent the cleaned collecting attachment part 90 from being contaminated again.

Further, in the housing frame 50, the supplying port 51 which supplies a supply toner to the developing device 32 (image forming part 11), and the collecting port 52 which receives the waste toner from each of the cleaning devices 28 and 34 (image forming part 11) are separately formed. Consequently, the supplying port 51 and the collecting port 52 can be formed so as to correspond to connecting portions with the image forming part 11. Hence, the empty case 41E is attached to the collecting attachment part 90 in a posture identical to a posture in which the toner case 41 is detached from the supplying attachment part 40. Consequently, it is not necessary to change the posture of the empty case 41E, so that it is possible to simplify the exchange operation for reusing the empty case 41E as the waste toner case 91. Further, the supplying port 51 and the collecting port 52 are closed by each of the shutters 53 and 54 in a state that the case main body 43 is detached from the supplying attachment part 40 or the collecting attachment part 90. In addition, it is not necessary to change the posture of the empty case 41E during the above-mentioned exchanging operation, so that it is possible to prevent the toner from dropping from the supplying port 51 or the collecting port 52.

Figure 9:
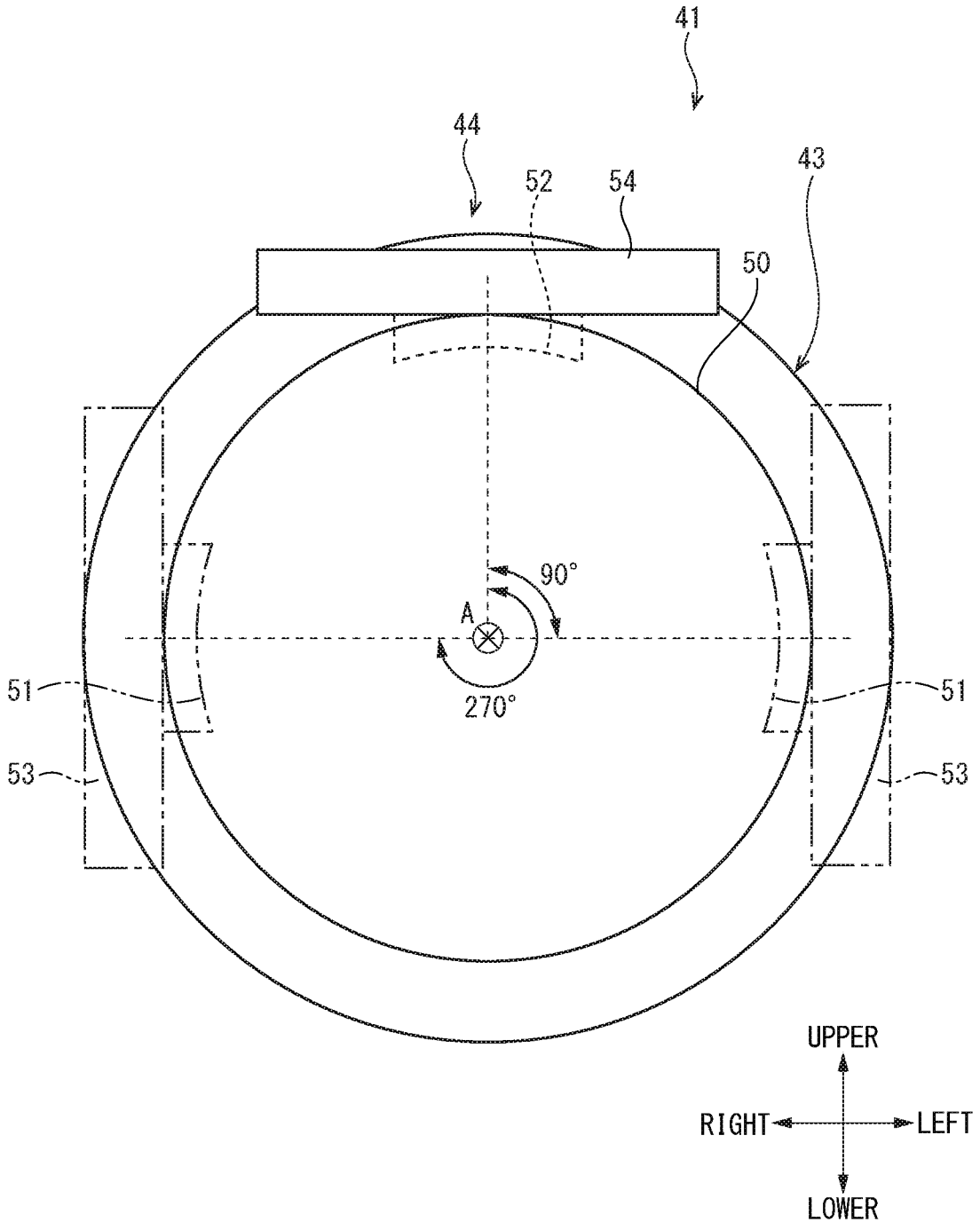
FIG. 9 is a rear view schematically showing a toner case according to another embodiment of the present disclosure.

Incidentally, the collecting port 52 of the toner case 41 according to the first embodiment is formed so as to be shifted 180 degrees in the circumferential direction from the supplying port 51. However, the present disclosure is not limited to this. As shown in FIG. 9, for example, in a range of 90 degrees to 270 degrees of an angle (center angle) formed between a perpendicular line drawn from the supplying port 51 to the rotation axis A and a perpendicular line drawn from the collecting port 52 to the rotation axis A, the supplying port 51 (supplying shutter 53) and the collecting port 52 (collecting shutter 54) may be formed. That is, the supplying port 51 may be formed in a range of ±90 degrees around the position facing the collecting port 52 in a circumferential direction of the case main body 43 (housing frame 50).

Figure 11:
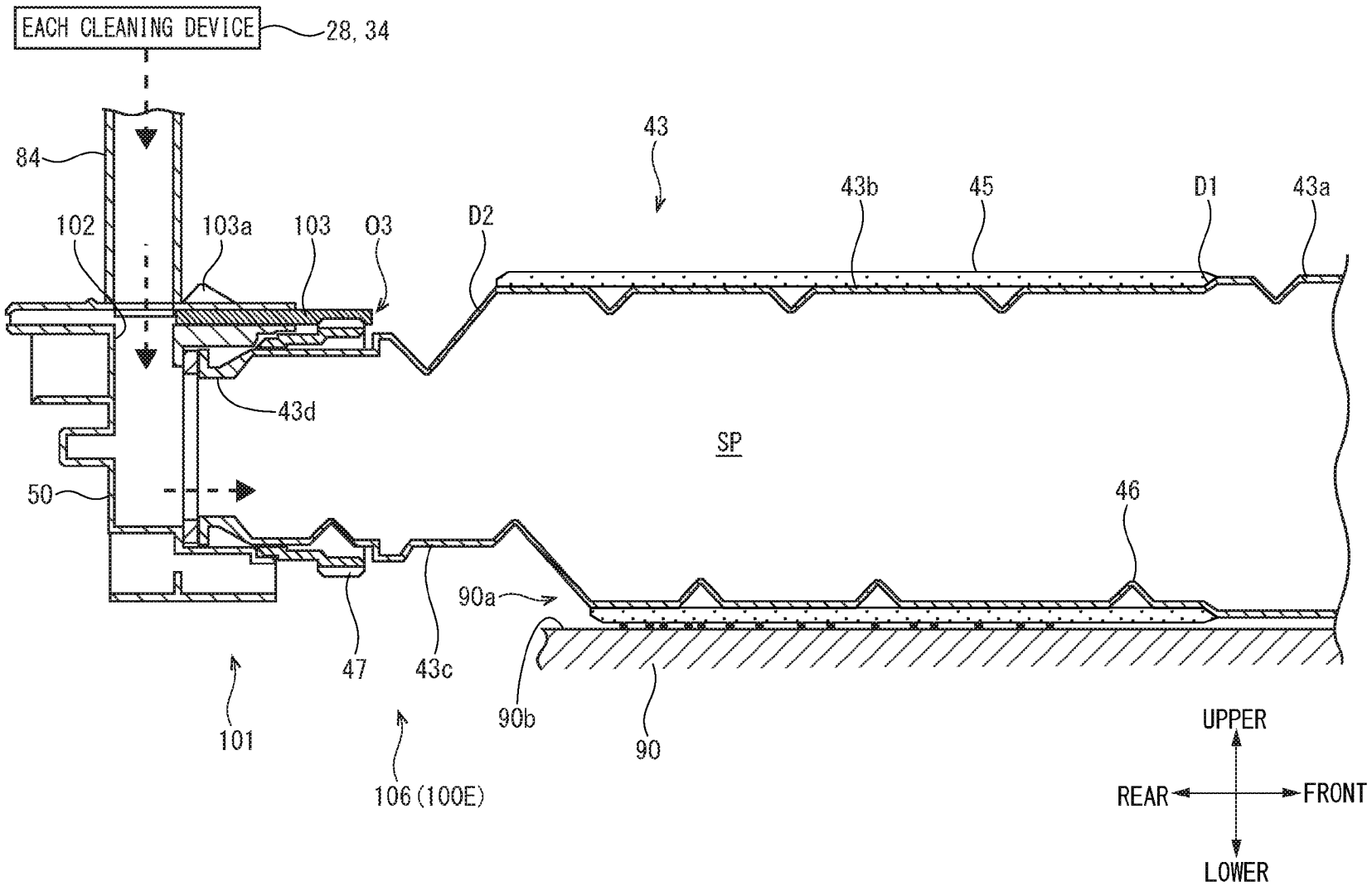
FIG. 11 is a sectional view showing a state that a waste toner case is attached to a collecting attachment part, according to the second embodiment of the present disclosure.

Next, a toner case 100 according to a second embodiment will be described with reference to FIGS. 10 and 11. FIG. 10 is a sectional view showing a state that the toner case 100 is attached to the supplying attachment part 40. FIG. 11 is a sectional view showing a state that a waste toner case 106 is attached to the collecting attachment part 90. Incidentally, in the following description, the same components as those of the toner case 41 according to the first embodiment will be assigned the same reference numerals and will not be described. Further, one toner case 100 will be described.

As shown in FIG. 10, the toner case 100 includes the case main body 43 and a cover member 101. The cover member 101 rotatably supports the case main body 43. The cover member 101 includes the housing frame 50, a communicating port 102 and a shutter 103.

The communicating port 102 is an opening which is the substantially same as the supplying port 51 and the collecting port 52. In the state that the toner case 100 (case main body 43) is attached to the supplying attachment part 40, the communicating port 102 is opened downward and is connected with the introducing port 32*a* (see FIG. 3) of the developing device 32 via the intermediate conveying part 42. Further, as shown in FIG. 11, in the state that the toner case 100 which becomes empty (empty case 100E) is attached to the collecting attachment part 90, the communicating port 102 is opened upward and is connected with each of the discharging ports 65 and 75 (see FIG. 7) of each of the cleaning devices 28 and 34 via the discharging conveying device 37.

As shown in FIG. 10, the shutter 103 employs the substantially same configuration as those of the supplying shutter 53 and the collecting shutter 54. The shutter 103 is slidable in the front and rear direction between an opening position O3 to open the communicating port 102 and a closing position C3 to close the communicating port 102. The shutter 103 opens the communicating port 102 in accordance with attachment of the case main body 43 to the supplying attachment part 40 or collecting attachment part 90, and closes the communicating port 102 in accordance with detachment of the case main body 43 from the supplying attachment part 40 or the collecting attachment part 90.

Hereinafter, a process (function) of attaching the toner case 100 to the supplying attachment part 40 or the collecting attachment part 90 will be described. In a state that the toner case 100 is detached from the supplying attachment part 40 or the collecting attachment part 90, the shutter 103 is displaced to the closing position C3 (see a two-dot chain line in FIG. 10). Incidentally, the same function as the function of the toner case 41 according to the first embodiment will not be described below.

As shown in FIG. 10, the toner case 100 is pushed backward from the front face of the supplying space part 40*a* with the grip part G placed at the near side and in a posture in which the communicating port 102 is oriented downward. When the toner case 100 is pushed, each protrusion part 103*a* of the shutter 103 interferes with an engagement part, and the shutter 103 moves from the closing position C3 to the opening position O3 (the communicating port 102 is opened). When the toner case 100 (case main body 43) is attached to the supplying attachment part 40, the communicating port 102 is connected with the intermediate supplying pipe 56 of the intermediate conveying part 42. The case main body 43 (conveying rib 46) rotates clockwise inside the supplying attachment part 40 so as to convey a supply toner toward the communicating port 102 formed at the rear side. Further, the supply toner is supplied to the developing device 32 (see a broken line arrow in FIG. 10). The cleaning member 45 rotates clockwise integrally with the case main body 43 in the state that the cleaning member 45 is in contact with the inner circumferential face 40*b* of the supplying attachment part 40. Consequently, it is possible to clean the inner circumferential face 40*b* of the supplying attachment part 40 contaminated by the leaked supply toner.

The empty case 100E is detached from the supplying attachment part 40 and is used as the waste toner case 106. As shown in FIG. 11, the empty case 100E is rotated upside down, and is attached to the collecting attachment part 90 (collecting space part 90*a*) in a posture in which the communicating port 102 is oriented upward. When the toner case 100 is pushed, the shutter 103 moves and the communicating port 102 is opened. When the case main body 43 is attached to the collecting attachment part 90, the communicating port 102 is connected with the conveying discharging pipe 84 of the discharging conveying device 37. The case main body 43 (conveying rib 46) rotates counterclockwise inside the collecting attachment part 90 so as to convey the waste toner introduced via the communicating port 102 forward (see a broken line arrow in FIG. 11). Further, the waste toner is collected in the case main body 43 (containing space SP). The cleaning member 45 rotates counterclockwise integrally with the case main body 43 in the state that the cleaning member 45 is in contact with the inner circumferential face 90*b* of the collecting attachment part 90. Consequently, it is possible to clean the inner circumferential face 90*b* of the collecting attachment part 90 contaminated by the leaked waste toner.

The cleaning member 45 holds the supply toner (waste toner) leaking via the communicating port 102, so that the toner case 100 (waste toner case 106) according to the second embodiment described above can prevent the apparatus main body 2 from being contaminated by the toner.

Figure 12:
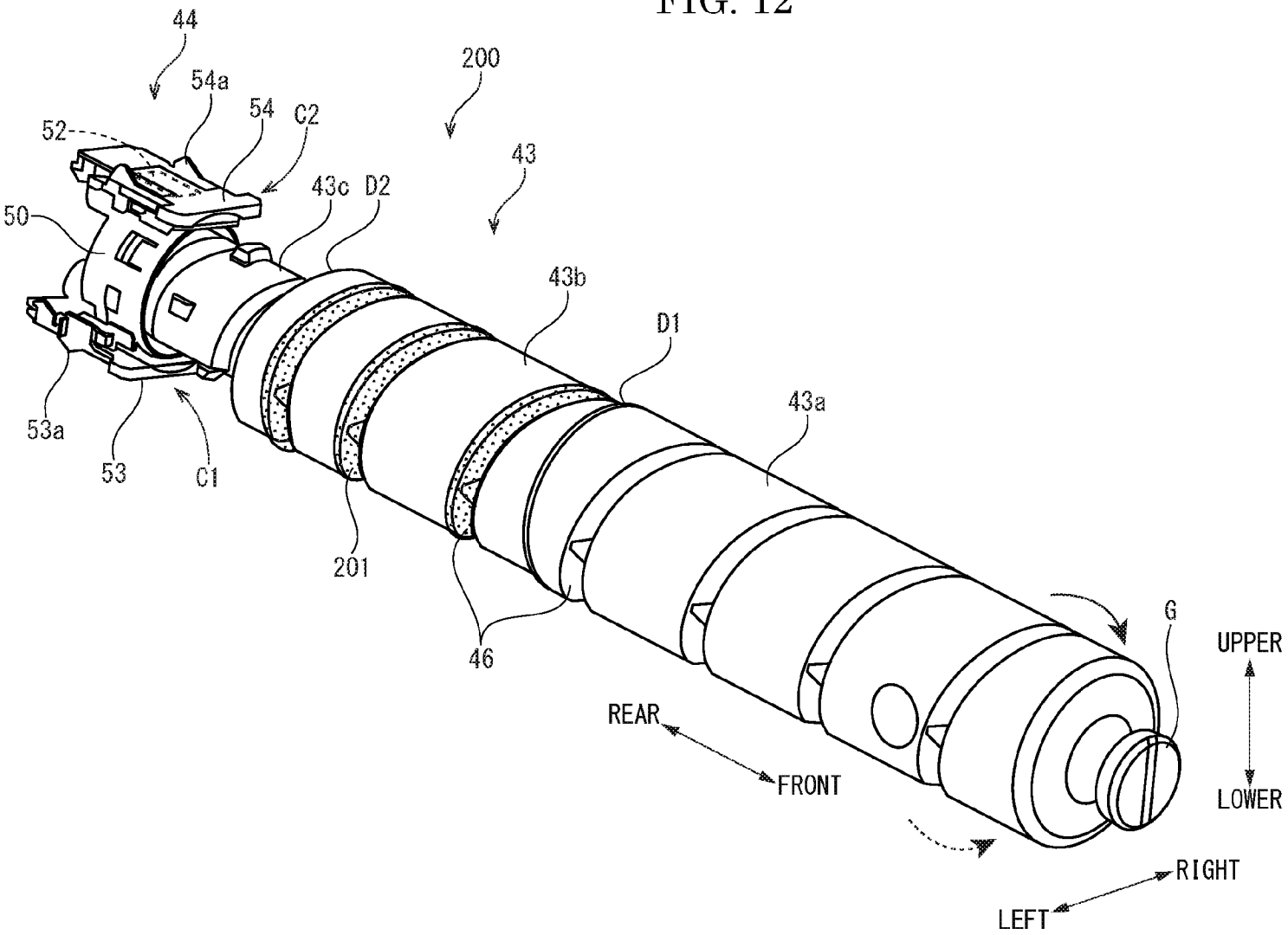
FIG. 12 is a perspective view showing a toner case according to a third embodiment of the present disclosure.
Figure 13:
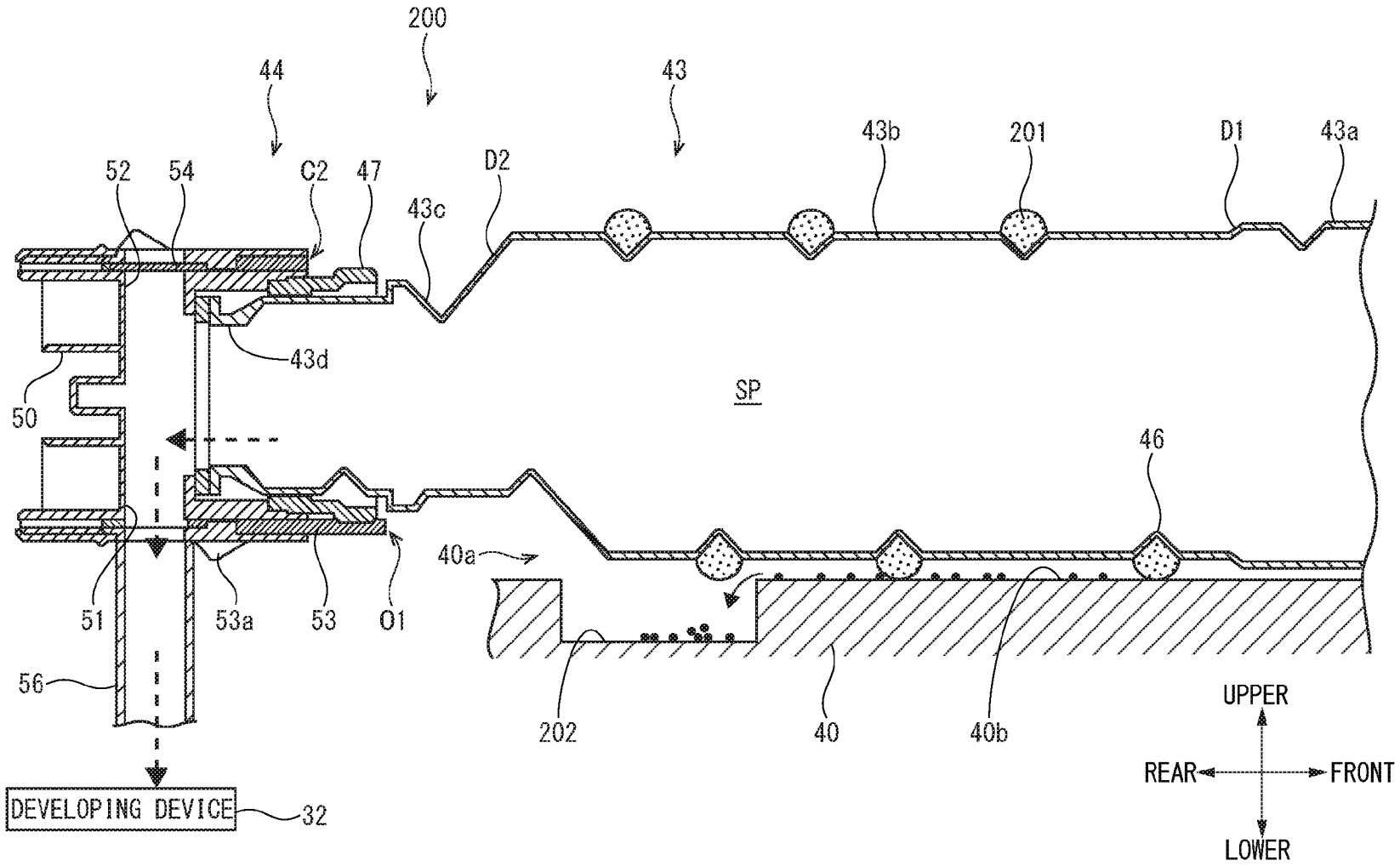
FIG. 13 is a sectional view showing a state that the toner case is attached to a supplying attachment part, according to the third embodiment of the present disclosure.
Figure 14:
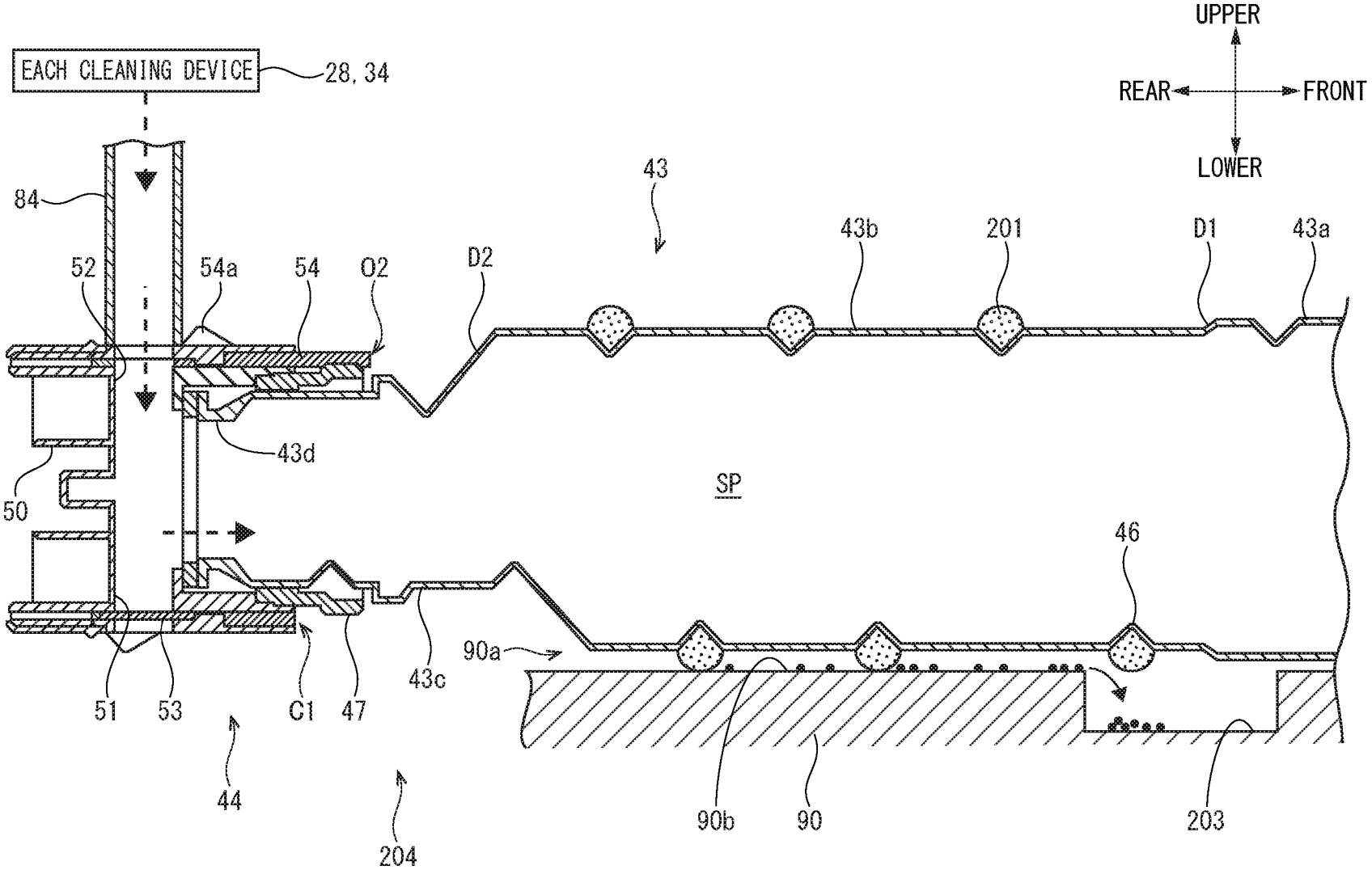
FIG. 14 is a sectional view showing a state that a waste toner case is attached to a collecting attachment part, according to the third embodiment of the present disclosure.

Next, a toner case 200 according to a third embodiment will be described with reference to FIGS. 12 to 14. FIG. 12 is a perspective view showing the toner case 200. FIG. 13 is a sectional view showing a state that the toner case 200 is attached to the supplying attachment part 40. FIG. 14 is a sectional view showing a state that a waste toner case 204 is attached to the collecting attachment part 90. Incidentally, in the following description, the same components as those of the toner case 41 according to the first embodiment will be assigned the same reference numerals, and will not be described. Further, one toner case 200 will be described.

As shown in FIGS. 12 and 13, a cleaning member 201 of the toner case 200 is formed in a spiral shape by rolling a pile material of a bar shape, for example. The cleaning member 201 is spirally wound around the outer circumferential face of the small diameter cylinder part 43*b*, and fixed thereto by an adhesive or a double-sided tape, for example. In more detail, the cleaning member 201 fits into the conveying rib 46 recessed on the outer circumferential face of the small diameter cylinder part 43*b*. That is, the cleaning member 201 draws the same spiral as that of the conveying rib 46. A thickness of the cleaning member 201 (except a portion fitting into the conveying rib 46) is greater than a thickness of the first stepped part D1. Incidentally, the cleaning member 201 may be formed in a spiral shape having a pitch different from that of the conveying rib 46. Incidentally, the cleaning member 201 may be composed of a nonwoven fabric or a brush, for example.

Similar to the toner case 41 according to the first embodiment, the toner case 200 is attachable to and detachable from the supplying attachment part 40 or the collecting attachment part 90. The cleaning member 201 rotates clockwise (in a first direction) with the case main body 43 in the supplying attachment part 40 so as to collect a supply toner to a rear side (a first side in the attachment and detachment direction). Meanwhile, the cleaning member 201 rotates counterclockwise (in a second direction) with the case main body 43 in the collecting attachment part 90 so as to collect a waste toner to a front side (a second side in the attachment direction and detachment direction).

As shown in FIG. 13, the supplying attachment part 40 includes a supply-side storing part 202 which stores the supply toner collected by the cleaning member 201. The supply-side storing part 202 is recessed on a lower part of the inner circumferential face 40*b* of the supplying attachment part 40. In a state that the toner case 200 is attached to the supplying attachment part 40, the supply-side storing part 202 is formed so that the supply-side storing part 202 faces a lower side of a rear end part (second stepped part D2) of the small diameter cylinder part 43*b*. Meanwhile, as shown in FIG. 14, the collecting attachment part 90 includes a collection-side storing part 203 which stores the waste toner collected by the cleaning member 201. The collection-side storing part 203 is recessed on a lower part of the inner circumferential face 90*b* of the collecting attachment part 90. In a state that the waste toner case 204 (empty toner case 200) is attached to the collecting attachment part 90, the collection-side storing part 203 is formed so that the collection-side storing part 203 faces a lower side of a front end part (first stepped part D1) of the small diameter cylinder part 43*b*. Incidentally, the above-mentioned storing part may be formed in at least one of the supplying attachment part 40 and the collecting attachment part 90.

In the toner case 200 (waste toner case 204) according to the third embodiment as described above, the cleaning member 201 conveys the supply toner (waste toner) on the inner circumferential face 40*b* of the supplying attachment part 40 (the inner circumferential face 90*b* of the collecting attachment part 90) to the rear side (to the front side). The collected supply toner is accumulated in the supply-side storing part 202, and the collected waste toner is accumulated in the collection-side storing part 203. Consequently, it is possible to gather the supply toner and the waste toner at one place, so that it is possible to collect the toner in each of the storing parts 202 and 203 at a time during maintenance, for example. Incidentally, the above-mentioned cleaning member 201 may be applied to the toner case 100 according to the second embodiment.

Incidentally, the cleaning members 45 and 201 of the toner cases 41, 100 and 200 according to the first to third embodiments are provided at the rear side (the first side in the attachment and detachment direction) of the case main body 43. However, the present disclosure is not limited to this. For example, the cleaning member may be arranged across the entire part in the front and rear direction of the case main body 43 (the large diameter cylinder part 43*a* and the small diameter cylinder part 43*b*) or may be arranged at the large diameter cylinder part 43*a*.

Incidentally, a case where the present disclosure is applied to the color printer 1 has been described as an example in the embodiment. However, the present disclosure is not limited to this, and may be applied to a monochrome printer, a copying machine, a facsimile or an MFP (multi-function peripheral).

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body which is capable of containing a toner supplied to an image forming part arranged inside an apparatus main body and is attachable to and detachable from a supplying attachment part of the apparatus main body along an attachment and detachment direction; and a cleaning member arranged at an outer circumferential face of the case main body, wherein the case main body rotates inside the supplying attachment part in a first direction so as to convey the toner toward a communicating port formed at a first side in the attachment and detachment direction, and in a state that the cleaning member is in contact with an inner circumferential face of the supplying attachment part, the cleaning member rotates integrally with the case main body in the first direction so as to clean the inner circumferential face of the supplying attachment part.

2. The toner case according to claim 1, wherein the case main body is capable of containing a toner discharged from the image forming part and is attachable to and detachable from a collecting attachment part of the apparatus main body, and the case main body rotates inside the collecting attachment part in a second direction so as to convey a toner introduced via the communicating port toward a second side in the attachment and detachment direction, and in a state that the cleaning member is in contact with an inner circumferential face of the collecting attachment part, the cleaning member rotates integrally with the case main body in the second direction so as to clean the inner circumferential face of the collecting attachment part.

3. The toner case according to claim 1, wherein the case main body is formed in a cylindrical shape elongated in the attachment and detachment direction, and the cleaning member is cylindrically wound around at least a first side part in the attachment and detachment direction of the case main body and holds a collected toner.

4. The toner case according to claim 1, wherein the case main body is formed in a cylindrical shape elongated in the attachment and detachment direction, and the cleaning member is spirally wound around at least a first side part in the attachment and detachment direction of the case main body, and the cleaning member rotates in the first direction so as to collect a toner to the first side in the attachment and detachment direction and rotates in a second direction so as to collect the toner to a second side in the attachment and detachment direction.

5. The toner case according to claim 1, wherein the case main body includes:

a large diameter cylinder part;

a small diameter cylinder part formed with a smaller diameter than the large diameter cylinder part and arranged at the first side in the attachment and detachment direction of the large diameter cylinder part; and a stepped part formed between the large diameter cylinder part and the small diameter cylinder part, and the cleaning member is wound around an outer circumferential face of the small diameter cylinder part, and a thickness of the cleaning member is greater than a thickness of the stepped part.

6. The toner case according to claim 1, further comprising a cover member configured to cover an opening part arranged at an end face of the case main body, wherein the cover member includes the communicating port.

7. An image forming apparatus comprising:

the toner case according to claim 1, and the image forming part arranged inside the apparatus main body.

8. An image forming apparatus comprising:

the toner case according to claim 4, and the image forming part arranged inside the apparatus main body, wherein the case main body is attachable to and detachable from a collecting attachment part of the apparatus main body, and at least one of the supplying attachment part and the collecting attachment part includes a storing part to store the toner collected by the cleaning member.

9. The image forming apparatus according to claim 8, wherein the case main body includes:

a large diameter cylinder part;

a small diameter cylinder part formed with a smaller diameter than the large diameter cylinder part and arranged at the first side in the attachment and detachment direction of the large diameter cylinder part;

a cylindrical piece formed with a smaller diameter than the small diameter cylinder part and arranged at the first side in the attachment and detachment direction of the small diameter cylinder part;

a first stepped part formed between the large diameter cylinder part and the small diameter cylinder part; and a second stepped part formed between the small diameter cylinder part and the cylindrical piece, and the storing part is formed at the supplying attachment part so that the storing part faces the second stepped part.

10. The image forming apparatus according to claim 8, wherein the case main body includes:

a large diameter cylinder part;

a small diameter cylinder part formed with a smaller diameter than the large diameter cylinder part and arranged at the first side in the attachment and detachment direction of the large diameter cylinder part;

a cylindrical piece formed with a smaller diameter than the small diameter cylinder part and arranged at the first side in the attachment and detachment direction of the small diameter cylinder part;

a first stepped part formed between the large diameter cylinder part and the small diameter cylinder part; and a second stepped part formed between the small diameter cylinder part and the cylindrical piece, and the storing part is formed at the collecting attachment part so that the storing part faces the first stepped part.

11. A toner case comprising:

a case main body which is capable of containing a toner supplied to an image forming part arranged inside an apparatus main body or a toner discharged from the image forming part and is attachable to and detachable from a supplying attachment part of the apparatus main body or a collecting attachment part of the apparatus main body along an attachment and detachment direction; and a cleaning member arranged at an outer circumferential face of the case main body, wherein the case main body rotates inside the supplying attachment part in a first direction so as to convey the toner toward a supplying port formed at a first side in the attachment and detachment direction, and the case main body rotates inside the collecting attachment part in a second direction so as to convey a toner introduced via a collecting port formed at the first side in the attachment and detachment direction toward a second side in the attachment and detachment direction, in a state that the cleaning member is in contact with an inner circumferential face of the supplying attachment part, the cleaning member rotates integrally with the case main body in the first direction so as to clean the inner circumferential face of the supplying attachment part, and in a state that the cleaning member is in contact with an inner circumferential face of the collecting attachment part, the cleaning member rotates integrally with the case main body in the second direction so as to clean the inner circumferential face of the collecting attachment part.

12. The toner case according to claim 11, wherein the case main body is formed in a cylindrical shape elongated in the attachment and detachment direction, and the cleaning member is cylindrically wound around at least a first side part in the attachment and detachment direction of the case main body and holds a collected toner.

13. The toner case according to claim 11, wherein the case main body is formed in a cylindrical shape elongated in the attachment and detachment direction, and the cleaning member is spirally wound around at least a first side part in the attachment and detachment direction of the case main body, and the cleaning member rotates in the first direction so as to collect a toner to the first side in the attachment and detachment direction and rotates in the second direction so as to collect the toner to the second side in the attachment and detachment direction.

14. The toner case according to claim 11, wherein the case main body includes:

a large diameter cylinder part;

a small diameter cylinder part formed with a smaller diameter than the large diameter cylinder part and arranged at the first side in the attachment and detachment direction of the large diameter cylinder part; and a stepped part formed between the large diameter cylinder part and the small diameter cylinder part, and the cleaning member is wound around an outer circumferential face of the small diameter cylinder part, and a thickness of the cleaning member is greater than a thickness of the stepped part.

15. The toner case according to claim 11, further comprising a cover member configured to cover an opening part arranged at an end face of the case main body, wherein the cover member includes the supplying port and the collecting port.

16. An image forming apparatus comprising:

the toner case according to claim 11, and the image forming part arranged inside the apparatus main body.

17. An image forming apparatus comprising:

the toner case according to claim 13, and the image forming part arranged inside the apparatus main body, wherein at least one of the supplying attachment part and the collecting attachment part includes a storing part to store the toner collected by the cleaning member.

18. The image forming apparatus according to claim 17, wherein the case main body includes:

a large diameter cylinder part;

a small diameter cylinder part formed with a smaller diameter than the large diameter cylinder part and arranged at the first side in the attachment and detachment direction of the large diameter cylinder part;

a cylindrical piece formed with a smaller diameter than the small diameter cylinder part and arranged at the first side in the attachment and detachment direction of the small diameter cylinder part;

a first stepped part formed between the large diameter cylinder part and the small diameter cylinder part; and a second stepped part formed between the small diameter cylinder part and the cylindrical piece, and the storing part is formed at the supplying attachment part so that the storing part faces the second stepped part.

19. The image forming apparatus according to claim 17, wherein the case main body includes:

a large diameter cylinder part;

a small diameter cylinder part formed with a smaller diameter than the large diameter cylinder part and arranged at the first side in the attachment and detachment direction of the large diameter cylinder part;

a cylindrical piece formed with a smaller diameter than the small diameter cylinder part and arranged at the first side in the attachment and detachment direction of the small diameter cylinder part;

a first stepped part formed between the large diameter cylinder part and the small diameter cylinder part; and a second stepped part formed between the small diameter cylinder part and the cylindrical piece, and the storing part is formed at the collecting attachment part so that the storing part faces the first stepped part.

* * * * *